US007311600B2

(12) United States Patent
Sundstrom

(10) Patent No.: US 7,311,600 B2
(45) Date of Patent: Dec. 25, 2007

(54) GAME BASED UPON FLUCTUATIONS OF AN OBJECTIVE ENVIRONMENT

(75) Inventor: Stephen J. Sundstrom, Belmont, CA (US)

(73) Assignee: Gameline, LLC, Belmont, CA (US)

( * ) Notice: Subject to any disclaimer, the term of this patent is extended or adjusted under 35 U.S.C. 154(b) by 1029 days.

(21) Appl. No.: 10/647,056

(22) Filed: Aug. 22, 2003

(65) Prior Publication Data

US 2005/0043078 A1 Feb. 24, 2005

(51) Int. Cl.
*A63F 9/24* (2006.01)

(52) U.S. Cl. ..... 463/17; 463/42; 273/269

(58) Field of Classification Search ..... None
See application file for complete search history.

(56) References Cited

U.S. PATENT DOCUMENTS 5,779,549 A 7/1998 Walker et al.
5,938,200 A * 8/1999 Markowicz et al. ..... 273/246
6,024,641 A 2/2000 Sarno
6,193,605 B1 2/2001 Libbey et al.
6,331,143 B1 12/2001 Yoseloff
6,443,840 B2 9/2002 Von Korn
6,592,454 B2 7/2003 Libbey et al.

OTHER PUBLICATIONS

The Great Weather Lottery, downloaded from www.cornwallwildlifetrust.org.uk/shopping/lottery.htm, copyright 2001, 9 pages.*

* cited by examiner

*Primary Examiner*—Mark Sager
(74) *Attorney, Agent, or Firm*—Ray K. Shahani, Esq.

(57) ABSTRACT

A method and apparatus for playing a game is provided. Unique indicia are assigned to each member of a plurality of groups. Each group is composed of entries that correspond to items that each have a value that is objective, arbitrary, and that fluctuates over time, e.g., the items in each group may correspond to the performance of openly traded instruments in the market. A performance value for of the each groups are calculated and displayed over a period of time. To play the game, a player makes of selection of one or more alphabetic characters to play in a race or a contest. The player may make the selection electronically by submission through a displayed user interface. In a set of games that lend itself to amusement and contests, the selection is scored based on the performance value associated with each unique indicium in the players selection. In set of games that lends itself to wagering or lottery type gaming, the selection is to be considered to be a winning selection if the characters of the selection correctly match the sequence of indicia produced by ordering the plurality of groups according to performance value from highest to lowest.

47 Claims, 26 Drawing Sheets
(20 of 26 Drawing Sheet(s) Filed in Color)

| | Letter | Gain |
|---|---|---|
| 3 | A | +0.7276% |
| 1 | B | +0.9079% |
| 8 | C | +0.4270% |
| 12 | D | +0.1068% |
| 2 | E | +0.8531% |
| 15 | F | -0.0921% |
| 9 | G | +0.3929% |
| 10 | H | +0.3542% |
| 19 | I | -0.3815% |
| 11 | JK | +0.2124% |
| 17 | L | -0.1148% |
| 7 | M | +0.4592% |
| 4 | N | +0.6654% |
| 20 | OQ | -0.6128% |
| 6 | P | +0.5034% |
| 18 | R | -0.2776% |
| 14 | S | +0.0141% |
| 5 | T | +0.5068% |
| 16 | UV | -0.1110% |
| 13 | WXYZ | +0.1511% |
| | ALL | +0.2376% |

| | 10:00-11:00 | | 11:00-12:00 | | 12:00-1:00 | | 1:00-2:00 | | 2:00-3:00 | | 3:00-4:00 | |
|---|---|---|---|---|---|---|---|---|---|---|---|---|
| | Letter | Gain | Letter | Gain | Letter | Gain | Letter | Gain | Letter | Gain | Letter | Gain |
| 1 | O | [illegible] | A | [illegible] | C | [illegible] | O | [illegible] | E | 0.1367% | O | [illegible] |
| 2 | A | [illegible] | I | [illegible] | O | [illegible] | A | [illegible] | D | -0.2170% | N | [illegible] |
| 3 | E | [illegible] | H | [illegible] | P | [illegible] | O | [illegible] | H | -0.2411% | S | [illegible] |
| 4 | G | [illegible] | E | [illegible] | S | [illegible] | H | [illegible] | M | -0.2470% | E | [illegible] |
| 5 | F | [illegible] | T | [illegible] | A | [illegible] | WXYZ | [illegible] | R | -0.2600% | T | [illegible] |
| 6 | O | [illegible] | L | [illegible] | G | [illegible] | O | [illegible] | N | -0.2554% | F | [illegible] |
| 7 | WXYZ | [illegible] | O | [illegible] | L | [illegible] | T | [illegible] | O | -0.2654% | H | [illegible] |
| 8 | S | [illegible] | WXYZ | [illegible] | E | [illegible] | UV | [illegible] | WXYZ | -0.2691% | E | [illegible] |
| 9 | T | [illegible] | G | [illegible] | L | [illegible] | E | [illegible] | I | -0.2699% | O | [illegible] |
| 10 | N | [illegible] | N | [illegible] | T | [illegible] | G | [illegible] | T | -0.3083% | G | [illegible] |
| 11 | M | [illegible] | N | [illegible] | I | [illegible] | F | [illegible] | QQ | -0.3129% | L | [illegible] |
| 12 | UV | [illegible] | S | [illegible] | H | [illegible] | S | [illegible] | E | -0.3170% | O | [illegible] |
| 13 | F | [illegible] | O | [illegible] | S | -0.3637% | E | [illegible] | G | -0.3210% | WXYZ | [illegible] |
| 14 | H | [illegible] | D | [illegible] | QQ | -0.3743% | L | [illegible] | UV | -0.3450% | UV | [illegible] |
| 15 | E | -0.1795% | QQ | [illegible] | X | -0.3357% | QQ | [illegible] | T | -0.3551% | A | [illegible] |
| 16 | R | -0.1861% | [illegible] | [illegible] | UV | -0.3801% | N | [illegible] | P | -0.3784% | E | [illegible] |
| 17 | T | -0.1932% | F | [illegible] | I | -0.4785% | I | -0.6084% | A | -0.4108% | I | [illegible] |
| 18 | S | -0.2058% | R | [illegible] | WXYZ | -0.1960% | P | -0.6119% | I | -0.4489% | P | [illegible] |
| 19 | QQ | -0.2326% | P | [illegible] | F | -0.1361% | R | -0.6452% | F | -0.4661% | R | [illegible] |
| 20 | I | -0.3461% | UV | [illegible] | N | -0.1611% | S | -0.6834% | S | -0.4897% | QQ | [illegible] |

FIG. 12

| Stock | Place | Percent Below | Previous Close | Opening Price | Last Sale | Price Change | Percent Change | Volume | Market |
|---|---|---|---|---|---|---|---|---|---|
| WFT | 40 | 96.10 | 37.800 | 36.970 | 38.600 | +1.830 | +4.8413 | 1087000 | NYSE |
| WWCA | 41 | 96.00 | 16.620 | 16.648 | 17.380 | +0.732 | +4.4043 | 2414898 | NASDAQ |
| WMB | 109 | 89.19 | 8.280 | 8.290 | 8.510 | +0.230 | +2.7778 | 2540100 | NYSE |
| XJT | 123 | 87.79 | 13.510 | 13.520 | 13.850 | +0.330 | +2.4426 | 383800 | NYSE |
| ZRAN | 134 | 86.69 | 24.690 | 24.460 | 25.030 | +0.570 | +2.3083 | 759988 | NASDAQ |
| WFMI | 145 | 85.59 | 54.620 | 54.420 | 55.600 | +1.180 | +2.1603 | 811534 | NASDAQ |
| XTO | 151 | 84.98 | 20.460 | 20.400 | 20.820 | +0.420 | +2.0528 | 639600 | NYSE |
| XRAY | 166 | 83.48 | 43.160 | 42.160 | 42.960 | +0.800 | +1.8779 | 711236 | NASDAQ |
| WSM | 196 | 80.28 | 29.830 | 29.820 | 30.310 | +0.490 | +1.6433 | 1008300 | NYSE |
| X | 225 | 77.58 | 17.200 | 17.150 | 17.400 | +0.250 | +1.4577 | 562400 | NYSE |
| WSTL | 227 | 77.38 | 7.670 | 7.620 | 7.730 | +0.110 | +1.4436 | 592645 | NASDAQ |
| WBSN | 244 | 75.68 | 22.910 | 22.750 | 23.050 | +0.300 | +1.3187 | 478033 | NASDAQ |
| WTW | 278 | 72.27 | 43.510 | 43.460 | 43.950 | +0.490 | +1.1278 | 145900 | NYSE |
| YHOO | 290 | 71.07 | 32.030 | 31.650 | 31.990 | +0.340 | +1.0743 | 7526127 | NASDAQ |
| XMSR | 299 | 70.17 | 12.650 | 12.410 | 12.540 | +0.130 | +1.0479 | 2354092 | NASDAQ |
| WEN | 307 | 69.37 | 29.280 | 29.150 | 29.450 | +0.300 | +1.0292 | 637100 | NYSE |
| XEL | 318 | 68.27 | 14.290 | 14.160 | 14.300 | +0.140 | +0.9887 | 833000 | NYSE |
| WPI | 360 | 64.06 | 39.700 | 39.650 | 39.980 | +0.330 | +0.8323 | 1163400 | NYSE |
| XOM | 365 | 63.56 | 36.680 | 36.500 | 36.800 | +0.300 | +0.8219 | 6668800 | NYSE |
| XLNX | 413 | 58.76 | 29.080 | 28.700 | 28.900 | +0.200 | +0.6969 | 6538835 | NASDAQ |
| WYNN | 432 | 56.86 | 15.580 | 15.500 | 15.600 | +0.100 | +0.6452 | 318800 | NASDAQ |
| YUM | 446 | 55.46 | 29.140 | 28.980 | 29.150 | +0.170 | +0.5836 | 990200 | NYSE |
| WMT | 456 | 54.45 | 58.880 | 58.450 | 58.780 | +0.330 | +0.5604 | 3896800 | NYSE |
| XRX | 474 | 52.65 | 10.080 | 10.000 | 10.050 | +0.050 | +0.4960 | 4619400 | NYSE |
| ZION | 509 | 49.15 | 57.260 | 57.250 | 57.480 | +0.230 | +0.4017 | 308829 | NASDAQ |
| WIN | 510 | 49.05 | 10.060 | 10.050 | 10.090 | +0.040 | +0.3980 | 664400 | NYSE |
| WDR | 513 | 48.75 | 25.990 | 25.900 | 26.000 | +0.100 | +0.3861 | 221400 | NYSE |
| WDC | 548 | 45.25 | 9.840 | 9.820 | 9.850 | +0.030 | +0.3053 | 2778300 | NYSE |
| WHR | 564 | 43.64 | 69.620 | 69.560 | 69.740 | +0.180 | +0.2586 | 443000 | NYSE |
| WMI | 605 | 39.54 | 26.090 | 26.040 | 26.080 | +0.040 | +0.1536 | 1454100 | NYSE |
| WERX | 617 | 38.34 | 16.980 | 16.880 | 16.900 | +0.020 | +0.1185 | 550114 | NASDAQ |
| WCN | 631 | 36.94 | 34.140 | 34.100 | 34.130 | +0.030 | +0.0880 | 102800 | NYSE |
| WERN | 634 | 36.64 | 25.000 | 24.780 | 24.800 | +0.020 | +0.0807 | 463812 | NASDAQ |
| ZBRA | 682 | 31.83 | 80.880 | 80.680 | 80.650 | -0.030 | -0.0372 | 243756 | NASDAQ |
| WB | 684 | 31.63 | 43.820 | 43.700 | 43.680 | -0.020 | -0.0458 | 3339300 | NYSE |
| YELL | 717 | 28.33 | 29.360 | 29.210 | 29.170 | -0.040 | -0.1369 | 817516 | NASDAQ |
| XL | 719 | 28.13 | 77.000 | 76.990 | 76.880 | -0.110 | -0.1429 | 495000 | NYSE |
| WPO | 734 | 26.63 | 679.400 | 676.000 | 674.750 | -1.250 | -0.1849 | 32856 | NYSE |
| WON | 767 | 23.32 | 30.500 | 30.490 | 30.400 | -0.090 | -0.2952 | 718800 | NYSE |
| WFC | 772 | 22.82 | 50.380 | 50.110 | 49.950 | -0.160 | -0.3193 | 3901200 | NYSE |
| WAG | 774 | 22.62 | 31.050 | 31.140 | 31.040 | -0.100 | -0.3211 | 1960200 | NYSE |

FIG. 14

| Word Races Leaderboard - August 7, 2003 - Market Closed | | | | | | | | |
|---|---|---|---|---|---|---|---|---|
| | 6 Letters | Gain | 7 Letters | Gain | 8 Letters | Gain | 9 Letters | Gain |
| 1 | mlarbhs | -0.3191% | bmchbank | -0.3077% | banchamlak | -0.2941% | bngblckman | -0.2887% |
| 2 | tmkmbl | -0.3182% | thachman | -0.3030% | blhphanam | -0.2722% | thblackmon | -0.2813% |
| 3 | rsmlbl | -0.3172% | blaltman | -0.2912% | blhotman | -0.2711% | jchnmblack | -0.2813% |
| 4 | bashkm | -0.3147% | blkatlman | -0.2813% | bakothmoon | -0.2711% | basknitogal | -0.2800% |
| 5 | bmmanth | -0.3129% | blackmn | -0.2795% | bcbookman | -0.2681% | bankcombs | -0.2712% |
| 6 | bbatman | -0.3129% | beckmanjl | -0.2795% | jnbalbman | -0.2671% | mblackton | -0.2688% |
| 7 | mbatmanh | -0.3129% | mblackman | -0.2795% | bnamalbtm | -0.2665% | jchasthclm | -0.2685% |
| 8 | mahalbak | -0.3121% | blankch | -0.2795% | blthacks | -0.2650% | xtnphantom | -0.2679% |
| 9 | jcbmba | -0.3100% | malhcbass | -0.2795% | blhantom | -0.2595% | tbphotoman | -0.2713% |
| 10 | bchman | -0.3102% | cblatman | -0.2795% | bgblackmn | -0.2590% | bothlkmass | -0.2677% |

| Word Races Loserboard - August 7, 2003 - Market Closed | | | | | | | | |
|---|---|---|---|---|---|---|---|---|
| | 6 Letters | Gain | 7 Letters | Gain | 8 Letters | Gain | 9 Letters | Gain |
| 1 | tufrldary | -0.2500% | videotres | -0.2145% | tyvradfox | -0.1872% | frodiquez | -0.1703% |
| 2 | fldiver | -0.2500% | deflowered | -0.2131% | foxdiver | -0.1872% | ifyoudare | -0.1608% |
| 3 | fivered | -0.2500% | videotx | -0.2097% | friedpuppy | -0.1897% | radiotrevy | -0.1608% |
| 4 | vidfire | -0.2500% | vidbozlar | -0.2097% | aufweider | -0.1885% | foxyaudrie | -0.1608% |
| 5 | vrfrled | -0.2500% | youdrive | -0.2097% | diveforple | -0.1883% | vdrhaolfie | -0.1530% |
| 6 | dfixer | -0.2484% | yourdodie | -0.2097% | truddycore | -0.1777% | firevardes | -0.1485% |
| 7 | redfire | -0.2484% | foxvdep | -0.2076% | devlpyro | -0.1761% | edfiuravis | -0.1485% |
| 8 | fierryder | -0.2484% | ardfiliver | -0.2077% | poordriver | -0.1761% | videotrea | -0.1485% |
| 9 | fizrider | -0.2484% | fredupred | -0.2059% | vidfrens | -0.1741% | xhurisdead | -0.1485% |
| 10 | frydie | -0.2484% | drelfus | -0.1989% | rfulwide | -0.1720% | fughfred | -0.1478% |

FIG. 15

| 8 Letters Leaderboard - August 7, 2003 - Market Closed | | | | |
|---|---|---|---|---|
| Place | Leaderboard | Gain | Loserboard | Gain |
| 1 | banchamlak | +0.2943% | ivyredfox | -0.1972% |
| 2 | bltnhansm | +0.2732% | foxdiver | -0.1972% |
| 3 | bjhotman | +0.2711% | friedpuppy | -0.1897% |
| 4 | bakothmoon | +0.2711% | aufweider | -0.1805% |
| 5 | hcbookman | +0.2691% | diveforpie | -0.1803% |
| 6 | johnlboman | +0.2671% | iruddygore | -0.1777% |
| 7 | hngmslbtm | +0.2625% | deviipyro | -0.1761% |
| 8 | blthacks | +0.2600% | powdrriver | -0.1761% |
| 9 | blhantom | +0.2595% | vidfreqs | -0.1741% |
| 10 | bgblackmn | +0.2590% | rfulwide | -0.1720% |
| 11 | mahbklyn | +0.2578% | flexdriver | -0.1720% |
| 12 | cwbymkshn | +0.2566% | fcrvexdlr | -0.1700% |
| 13 | blkbtmnyc | +0.2563% | deyrious | -0.1700% |
| 14 | hjbomanns | +0.2556% | suzieroddy | -0.1700% |
| 15 | soobahkman | +0.2536% | diffuseyou | -0.1683% |
| 16 | jtchoban | +0.2543% | deuxfois | -0.1683% |
| 17 | jonathancb | +0.2543% | diverfitz | -0.1680% |
| 18 | markbachmann | +0.2540% | friedxeggs | -0.1670% |
| 19 | pathblack | +0.2538% | fsupride | -0.1666% |
| 20 | tombalch | +0.2533% | ispyfred | -0.1654% |
| 21 | lockmanb | +0.2531% | dadfigure | -0.1653% |
| 22 | blcksanta | +0.2522% | avdegrif | -0.1653% |
| 23 | watchmanbc | +0.2522% | reiduwsguy | -0.1640% |
| 24 | blhantmx | +0.2502% | fdizerega | -0.1640% |
| 25 | hmsjacob | +0.2494% | geediwarfa | -0.1640% |

FIG. 16

| U.S. Cities Leaderboard - August 20, 2003 - Market Closed | | | | | | | | |
|---|---|---|---|---|---|---|---|---|
| | 6 Letters | Gain | 7 Letters | Gain | 8 Letters | Gain | 9 Letters | Gain |
| 1 | Seffner FL | [illegible] | Elk Falls KS | [illegible] | Essex Fells NJ | [illegible] | San Rafael CA | [illegible] |
| 2 | Neal KS | [illegible] | Roselle NJ | [illegible] | Lasker NC | [illegible] | La France SC | [illegible] |
| 3 | Lane KS | [illegible] | Jefferson OR | [illegible] | Clarks NE | [illegible] | Florence KS | [illegible] |
| 4 | Allen KS | [illegible] | Jeffers MN | [illegible] | Jefferson CO | [illegible] | Sand Lake FL | [illegible] |
| 5 | Selden KS | [illegible] | Randall KS | [illegible] | Jefferson NC | [illegible] | Flanders NJ | [illegible] |
| 6 | Leon KS | [illegible] | Offerle KS | [illegible] | Jefferson SC | [illegible] | Jefferson LA | [illegible] |
| 7 | Dresden KS | [illegible] | Fords NJ | [illegible] | Florence SC | [illegible] | Jefferson AL | [illegible] |
| 8 | Sewell NJ | [illegible] | Los Ojos NM | [illegible] | Lake Andes SD | [illegible] | Falkner MS | [illegible] |
| 9 | Nolee KY | [illegible] | Kensal ND | [illegible] | Larned KS | [illegible] | Greenleaf KS | [illegible] |
| 10 | Clarks LA | [illegible] | Kendall KS | [illegible] | Lenora KS | [illegible] | Cross Creek FL | [illegible] |

| U.S. Cities Loserboard - August 20, 2003 - Market Closed | | | | | | | | |
|---|---|---|---|---|---|---|---|---|
| | 6 Letters | Gain | 7 Letters | Gain | 8 Letters | Gain | 9 Letters | Gain |
| 1 | Whitby WV | [illegible] | Ibapah UT | [illegible] | Tipp City OH | [illegible] | Bob White WV | [illegible] |
| 2 | Waipahu HI | [illegible] | High View WV | [illegible] | Hepzibah WV | [illegible] | Whitetop VA | [illegible] |
| 3 | Piqua OH | [illegible] | Batavia OH | [illegible] | Huachuca City AZ | [illegible] | Plymouth WI | [illegible] |
| 4 | Hiawatha WV | [illegible] | Ophir UT | [illegible] | Hilltop WV | [illegible] | Plymouth MI | [illegible] |
| 5 | Hiawatha UT | [illegible] | Opheim MT | [illegible] | Murphy ID | [illegible] | High Point MO | [illegible] |
| 6 | Philippi WV | [illegible] | Ohio City OH | [illegible] | Hephzibah GA | [illegible] | Whitewood VA | [illegible] |
| 7 | Bath NI | [illegible] | Ohio City CO | [illegible] | Ampthill VA | [illegible] | Port Hope MI | [illegible] |
| 8 | Hope MI | [illegible] | White PA | [illegible] | Highwood MT | [illegible] | Chaptico MD | [illegible] |
| 9 | Hico WV | [illegible] | Hoquiam WA | [illegible] | Hop Bottom PA | [illegible] | Ephraim UT | [illegible] |
| 10 | Hope ID | [illegible] | Hoquah WI | [illegible] | Gotham WI | [illegible] | Humboldt IL | [illegible] |

FIG. 17

| Stock Races Letter Statistics - Last 100 Days | | | | | | | | | | | | | | | |
|---|---|---|---|---|---|---|---|---|---|---|---|---|---|---|---|
| Letter | Rnkr | Letter | Gain | Letter | Place | Letter | Win | Letter | Top 3 | Letter | Top 5 | Letter | Adjm | Letter | Volume |
| [illegible] | 1 | UV | [illegible] | F | 9.87 | I | 14% | I | 22% | G | 38% | I | 5.82 | S | 4888539 |
| I | 2 | I | [illegible] | UV | 9.99 | G | 9% | G | 23% | OQ | 37% | G | 5.78 | [illegible] | 4067706 |
| JK | 3 | F | [illegible] | P | 10.01 | [illegible] | 7% | [illegible] | 20% | P | 37% | OQ | 5.60 | A | 3869424 |
| G | 4 | [illegible] | [illegible] | A | 10.11 | [illegible] | 7% | OQ | 18% | [illegible] | 34% | [illegible] | 5.54 | [illegible] | 3851607 |
| F | 5 | G | [illegible] | I | 10.16 | S | 6% | A | 18% | S | 33% | P | 5.36 | [illegible] | 2509809 |
| E | 7 | S | [illegible] | G | 10.16 | UV | 5% | H | 17% | UV | 33% | [illegible] | 5.31 | JK | 2173427 |
| C | 8 | A | [illegible] | JK | 10.19 | OQ | 5% | I | 16% | F | 32% | S | 5.24 | I | 2358713 |
| [illegible] | 9 | OQ | [illegible] | OQ | 10.34 | A | 5% | UV | 16% | [illegible] | 31% | [illegible] | 5.01 | [illegible] | 2311715 |
| [illegible] | 10 | P | [illegible] | I | 10.26 | [illegible] | 5% | P | 15% | E | 31% | I | 4.87 | [illegible] | 2294960 |
| S | 11 | JK | [illegible] | S | 10.34 | R | 5% | S | 14% | R | 30% | [illegible] | 4.88 | WXYZ | 2135304 |
| UV | 12 | R | [illegible] | R | 10.49 | I | 4% | P | 14% | I | 29% | H | 4.79 | OQ | 2036282 |
| H | 14 | I | [illegible] | [illegible] | 10.57 | H | 4% | F | 13% | L | 28% | WXYZ | 4.77 | [illegible] | 1936525 |
| OQ | 15 | [illegible] | [illegible] | [illegible] | 10.58 | [illegible] | 4% | [illegible] | 13% | A | 28% | [illegible] | 4.75 | P | 1873547 |
| [illegible] | 17 | H | [illegible] | E | 10.87 | H | 4% | [illegible] | 13% | H | 28% | UV | 4.75 | G | 1852271 |
| I | 20 | E | [illegible] | H | 10.87 | F | 3% | [illegible] | 13% | JK | 27% | E | 4.74 | E | 1748192 |
| R | 22 | [illegible] | [illegible] | [illegible] | 10.91 | E | 3% | [illegible] | 13% | [illegible] | 26% | I | 4.64 | F | 1618662 |
| L | 28 | [illegible] | [illegible] | [illegible] | 10.97 | P | 3% | R | 13% | E | 26% | A | 4.57 | I | 1581454 |
| A | 32 | [illegible] | [illegible] | I | 11.00 | [illegible] | 3% | JK | 12% | [illegible] | 26% | JK | 4.54 | UV | 1559512 |
| P | 47 | [illegible] | [illegible] | [illegible] | 11.14 | [illegible] | 2% | E | 10% | [illegible] | 23% | R | 4.50 | H | 1336545 |
| WXYZ | 57 | WXYZ | [illegible] | WXYZ | 11.56 | WXYZ | 2% | WXYZ | 8% | WXYZ | 23% | F | 4.42 | R | 1061693 |

FIG. 18

Word Races Results - Last 20 Days

| Date | 1 | 2 | 3 | 4 | 5 | 6 | 7 | 8 | 9 | 10 | 11 | 12 | 13 | 14 | 15 | 16 | 17 | 18 | 19 | 20 | ALL Gain |
|---|---|---|---|---|---|---|---|---|---|---|---|---|---|---|---|---|---|---|---|---|---|
| Aug 6 | M | G | D | R | N | JK | L | F | E | WZ | P | C | UV | G | OQ | S | H | A | T | I | -0.193% |
| Aug 5 | D | E | WZ | H | O | UV | JK | R | F | T | D | G | P | OQ | S | L | A | I | M | C | 1.527% |
| Aug 4 | S | A | N | JK | O | I | S | P | H | E | M | L | WZ | UV | T | OQ | F | R | D | G | -0.191% |
| Aug 1 | UV | JK | WZ | C | F | P | E | B | OQ | R | M | D | N | S | H | A | G | I | T | L | -0.664% |
| Jul 31 | I | S | R | WZ | P | E | D | JK | L | OQ | A | H | G | N | F | M | C | T | UV | B | -0.112% |
| Jul 30 | H | G | JK | P | R | M | D | UV | F | WZ | S | E | T | A | I | B | C | L | N | OQ | -0.489% |
| Jul 29 | OQ | P | H | E | G | F | UV | A | JK | I | S | B | R | T | C | M | D | L | WZ | N | -0.578% |
| Jul 28 | UV | T | OQ | D | A | F | WZ | I | S | R | H | P | O | B | G | L | M | JK | N | E | -0.172% |
| Jul 25 | D | S | WZ | A | G | OQ | B | M | O | P | H | JK | L | T | N | F | I | R | E | UV | -0.[illegible]% |
| Jul 24 | G | P | H | B | I | UV | S | JK | M | E | A | R | T | F | O | L | OQ | WZ | E | C | -0.381% |
| Jul 23 | I | M | UV | OQ | E | M | JK | D | T | A | F | L | G | R | S | P | B | S | WZ | H | -1.0[illegible]% |
| Jul 22 | T | S | D | L | WZ | F | C | D | OQ | H | JK | A | UV | R | P | I | G | N | M | E | -0.[illegible]% |
| Jul 21 | H | OQ | G | P | B | S | F | I | JK | E | A | R | D | T | WZ | N | UV | L | M | C | -0.300% |
| Jul 18 | R | S | N | G | P | D | E | F | JK | L | I | OQ | WZ | H | UV | JK | T | M | I | A | -0.[illegible]% |
| Jul 17 | G | E | D | P | H | WZ | A | S | R | D | M | T | UV | N | E | L | JK | F | OQ | I | -1.339% |
| Jul 16 | M | P | JK | B | G | F | WZ | D | N | OQ | R | A | H | S | I | T | L | UV | E | C | -1.218% |
| Jul 15 | UV | T | L | WZ | R | OQ | I | M | P | G | F | H | N | D | S | E | C | JK | A | N | -1.100% |
| Jul 14 | JK | L | R | M | G | I | F | N | UV | S | D | A | C | T | OQ | E | WZ | P | H | B | -0.[illegible]% |
| Jul 11 | I | A | P | T | JK | D | WZ | R | UV | OQ | F | E | N | S | H | C | G | D | L | M | -1.[illegible]% |
| Jul 10 | L | B | D | H | JK | P | F | A | C | G | N | OQ | S | M | WZ | E | R | T | I | UV | -0.075% |

FIG. 19

Stock Races Scatter Table - Last 100 Days

| Letter | 1 | 2 | 3 | 4 | 5 | 6 | 7 | 8 | 9 | 10 | 11 | 12 | 13 | 14 | 15 | 16 | 17 | 18 | 19 | 20 |
|---|---|---|---|---|---|---|---|---|---|---|---|---|---|---|---|---|---|---|---|---|
| A | 5 | 0 | 3 | 3 | 3 | 4 | 3 | 5 | 4 | 10 | 5 | 8 | 4 | 4 | 6 | 7 | 2 | 5 | 3 | 3 |
| B | 5 | 6 | 2 | 4 | 3 | 3 | 5 | 8 | 8 | 2 | 4 | 4 | 4 | 12 | 3 | 6 | 3 | 6 | 8 | 3 |
| C | 7 | 2 | 4 | 8 | 3 | 2 | 6 | 12 | 1 | 3 | 3 | 7 | 2 | 3 | 4 | 7 | 7 | 4 | 5 | 13 |
| D | 3 | 6 | 5 | 3 | 6 | 6 | 3 | 3 | 7 | 6 | 4 | 4 | 8 | 3 | 6 | 2 | 4 | 3 | 5 | 9 |
| E | 3 | 4 | 3 | 5 | 7 | 4 | 5 | 7 | 4 | 7 | 2 | 10 | 3 | 2 | 7 | 8 | 5 | 5 | 6 | 3 |
| F | 3 | 5 | 5 | 3 | 4 | 12 | 9 | 8 | 2 | 3 | 6 | 5 | 2 | 6 | 7 | 3 | 2 | 8 | 2 | 0 |
| G | 9 | 6 | 7 | 6 | 9 | 3 | 4 | 3 | 4 | 7 | 3 | 4 | 3 | 3 | 3 | 3 | 7 | 7 | 5 | 8 |
| H | 4 | 4 | 9 | 3 | 2 | 6 | 1 | 4 | 5 | 6 | 8 | 7 | 5 | 5 | 7 | 4 | 4 | 5 | 8 | 9 |
| I | 14 | 2 | 6 | 2 | 2 | 5 | 3 | 5 | 0 | 3 | 3 | 4 | 6 | 4 | 5 | 3 | 11 | 7 | 6 | 5 |
| J | 4 | 3 | 5 | 5 | 7 | 3 | 6 | 9 | 8 | 3 | 7 | 7 | 6 | 4 | 2 | 3 | 6 | 3 | 4 | 5 |
| K | 4 | 10 | 6 | 4 | 3 | 3 | 3 | 2 | 6 | 4 | 4 | 5 | 5 | 2 | 5 | 6 | 7 | 6 | 3 | 1 |
| L | 7 | 3 | 3 | 5 | 6 | 8 | 6 | 5 | 1 | 2 | 5 | 3 | 5 | 7 | 4 | 6 | 7 | 4 | 5 | 6 |
| M | 2 | 4 | 7 | 3 | 5 | 5 | 5 | 4 | 7 | 6 | 3 | 4 | 8 | 3 | 9 | 4 | 3 | 4 | 6 | 6 |
| N | 5 | 7 | 6 | 2 | 8 | 9 | 5 | 6 | 6 | 4 | 2 | 3 | 3 | 1 | 3 | 7 | 3 | 3 | 5 | 12 |
| O | 3 | 8 | 4 | 13 | 5 | 4 | 5 | 3 | 6 | 4 | 7 | 2 | 3 | 5 | 2 | 3 | 6 | 3 | 8 | 6 |
| P | 5 | 1 | 7 | 5 | 6 | 6 | 3 | 4 | 6 | 4 | 5 | 7 | 9 | 7 | 4 | 4 | 3 | 4 | 3 | 5 |
| Q | 6 | 7 | 1 | 9 | 6 | 4 | 4 | 6 | 4 | 3 | 4 | 1 | 5 | 7 | 8 | 5 | 8 | 7 | 2 | 3 |
| R | 4 | 6 | 4 | 7 | 2 | 4 | 8 | 2 | 8 | 7 | 8 | 5 | 5 | 6 | 5 | 6 | 3 | 7 | 5 | 0 |
| UV | 5 | 6 | 5 | 4 | 5 | 8 | 8 | 2 | 6 | 5 | 4 | 7 | 8 | 7 | 3 | 4 | 4 | 4 | 3 | 4 |
| WXYZ | 2 | 0 | 6 | 4 | 6 | 5 | 8 | 2 | 2 | 8 | 5 | 3 | 6 | 6 | 7 | 7 | 5 | 5 | 6 | 6 |

FIG. 20

Hour Races Past Results - Last 20 Days

| Date | 10:00 | 11:00 | 12:00 | 1:00 | 2:00 | 3:00 |
|---|---|---|---|---|---|---|
| August 19 | WXYZ | E | H | I | G | [illegible] |
| August 18 | G | I | I | G | I | [illegible] |
| August 14 | I | H | S | WXYZ | A | P |
| August 13 | WXYZ | H | G | T | UV | QQ |
| August 12 | [illegible] | T | [illegible] | R | S | R |
| August 11 | QQ | [illegible] | UV | G | T | [illegible] |
| August 8 | R | P | G | R | H | R |
| August 7 | S | A | [illegible] | [illegible] | E | [illegible] |
| August 6 | P | QQ | [illegible] | [illegible] | [illegible] | E |
| August 5 | WXYZ | [illegible] | F | H | R | H |
| August 4 | [illegible] | A | [illegible] | UV | E | F |
| August 1 | [illegible] | [illegible] | F | QQ | P | H |
| July 31 | S | P | UV | I | R | QQ |
| July 30 | [illegible] | G | S | E | F | H |
| July 29 | R | [illegible] | UV | QQ | QQ | I |
| July 28 | [illegible] | UV | I | [illegible] | S | G |
| July 27 | H | [illegible] | WXYZ | A | [illegible] | QQ |
| July 24 | P | [illegible] | G | I | H | G |
| July 23 | UV | F | E | [illegible] | I | [illegible] |
| July 22 | [illegible] | [illegible] | F | H | F | WXYZ |

FIG. 21

| Word Races Leaderboard - Last 30 Days | | | | | | | | |
|---|---|---|---|---|---|---|---|---|
| Date | 6 Letters | Gain | 7 Letters | Gain | 8 Letters | Gain | 9 Letters | Gain |
| Aug 6 | rynnbk | -0.0353% | brklybnd | -0.0869% | blkwndrwnn | -0.0839% | mdpkbryanm | -0.1074% |
| Aug 5 | vfyohnwvd | -0.0883% | helyhuddle | -1.0442% | hubbyofdj | -1.0883% | hotfldguy | -1.0867% |
| Aug 4 | askcyow | -0.1589% | jaysonsc | -0.1747% | snowcajun | -0.1804% | cvanskyhoc | -0.2184% |
| Aug 1 | ooapfcx | -0.0841% | uzzfmcqe | -0.7153% | peachfox | -0.7218% | mmpeachfuz | -0.7548% |
| Jul 31 | ojkller | -0.2368% | kbinfo | -0.3061% | jiflover | -0.2814% | jonflipper | -0.4224% |
| Jul 30 | jgahrm | -0.1297% | kermhogas | -0.1701% | khgoffer | -0.3013% | rhegnxeako | -0.2179% |
| Jul 29 | twoddhoop | -0.3386% | podilbk | -0.2490% | dphotoguy | -0.3898% | fdhtbzupdo | -0.2777% |
| Jul 28 | mcllvt | -0.3140% | loaticu | -0.7779% | claudiot | -0.7007% | cumalotido | -0.7232% |
| Jul 25 | mckaos | -1.1958% | jcampos | -1.1335% | gccjazonn | -1.1344% | psamoncik | -1.0722% |
| Jul 24 | frdhjg | -0.5362% | kkgraphi | -0.5668% | sheggyprk | -0.5771% | dfgraphix | -0.5288% |
| Jul 23 | ttanneru | -0.3982% | nautajerk | -0.4342% | rekrutrman | -0.4234% | marketfun | -0.3938% |
| Jul 22 | tcldolls | -0.2699% | stacytol | -0.0318% | xsolidxtc | -0.0374% | dustysocal | -0.0138% |
| Jul 21 | asberger | -0.7739% | ghabear | -0.7802% | aghalbers | -0.8031% | hergsharon | -0.8174% |
| Jul 18 | sbruner | -1.0321% | bsunder | -0.9923% | snyderbu | -0.9739% | evrybdynos | -0.9518% |
| Jul 17 | ghasbach | -1.1723% | begchas | -1.1966% | ashleygab | -1.1253% | bleachpadg | -1.2488% |
| Jul 16 | jofrommd | -0.7380% | marjfordm | -0.7815% | dkfarquhar | -0.8123% | dakforhim | -0.8413% |
| Jul 15 | flouvvthw | -0.8489% | tofiygu | -0.8898% | fthofjuly | -0.7389% | golfmktguy | -0.7438% |
| Jul 14 | elfaca | -0.3268% | elfpica | -0.2212% | callfprep | -0.2071% | pfcmaller | -0.1897% |
| Jul 11 | skeltht | -0.8714% | hattlakp | -0.8408% | davidkeeth | -0.8311% | takeuchlp | -0.8160% |
| Jul 10 | lynhfg | -0.4777% | whiffling | -0.8381% | bignhaff | -0.8313% | flyinghobo | -0.8895% |

FIG. 22

| U.S. Cities Leaderboard - Last 20 Days | | | | | | | | |
|---|---|---|---|---|---|---|---|---|
| Date | 6 Letters | Gain | 7 Letters | Gain | 8 Letters | Gain | 9 Letters | Gain |
| Aug 6 | Bryan KY | -0.1081% | Parkman WY | -0.1175% | Bryn Mawr PA | -0.1173% | Amanda Park WA | -0.1217% |
| Aug 5 | Ohley WV | -1.0473% | Dorothy WV | -1.0866% | Harold WV | -1.1074% | Red House WV | -1.1258% |
| Aug 4 | Owasco NY | -0.1606% | Conway KS | -0.1747% | Mc Comas WV | -0.1891% | Snow Camp NC | -0.2077% |
| Aug 3 | Coffey MO | -0.6958% | Mc Coy VA | -0.7085% | Wycombe PA | -0.7716% | Cherry Fork OH | -0.7713% |
| Jul 31 | Kiefer OK | [illegible] | Laquire OK | [illegible] | Oak Park IL | [illegible] | Lake Fork IL | [illegible] |
| Jul 30 | Fargo OK | -0.1872% | Graham OK | -0.1718% | Gorham KS | -0.2054% | Mc Grath AK | -0.2361% |
| Jul 29 | Hope ID | -0.3434% | Thorp WI | -0.3637% | Tipp City OH | -0.2721% | Good Hope IL | -0.2899% |
| Jul 28 | Utica IL | [illegible] | Toluca IL | [illegible] | Clutch City TX | [illegible] | Coal City WV | [illegible] |
| Jul 25 | Smoaks SC | [illegible] | Smock PA | [illegible] | Ashcamp KY | [illegible] | Snow Camp NC | [illegible] |
| Jul 24 | Darragh PA | -0.5419% | Gray Hawk KY | -0.5630% | Parrish FL | -0.5958% | La Harpe KS | -0.6157% |
| Jul 23 | Turner AR | [illegible] | Gretna VA | [illegible] | Nut Tree CA | [illegible] | Mount Vernon AR | [illegible] |
| Jul 22 | Atascosa TX | [illegible] | Los Altos CA | [illegible] | Los Gatos CA | [illegible] | Lost City WV | [illegible] |
| Jul 21 | Rogers AR | -0.7993% | Biggers AR | -0.8076% | Greensboro GA | -0.8094% | Greensboro AL | -0.8169% |
| Jul 18 | Snyder NE | [illegible] | Surrey ND | [illegible] | Bens Run WV | [illegible] | New Underwood SD | [illegible] |
| Jul 17 | Baxley GA | -1.1064% | Gable SC | -1.1125% | La Barge WY | -1.1400% | Blue Gap AZ | -1.1736% |
| Jul 16 | Fork MD | -0.7388% | Fajardo PR | -0.8033% | Frankford MO | -0.8368% | Dry Fork VA | -0.8428% |
| Jul 15 | Lookout KY | -0.6698% | Le Roy WV | -0.7129% | Footville WI | -0.7948% | Plymouth FL | -0.7980% |
| Jul 14 | La Place LA | [illegible] | La Place IL | [illegible] | Leck Kill PA | [illegible] | Palma Ceia FL | [illegible] |
| Jul 11 | Keaau HI | [illegible] | Hi Hat KY | [illegible] | Pepper Pike OH | [illegible] | Rich Creek VA | [illegible] |
| Jul 10 | Bangall NY | -0.4985% | Gilby ND | -0.5561% | Eagle Bay NY | -0.5617% | Eglin Afb FL | -0.5857% |

FIG. 23

| Place | Racer | Gain |
|---|---|---|
| 1 | Cancer | +0.8280% |
| 2 | Leo | +0.7882% |
| 3 | Aries | +0.7783% |
| 4 | Taurus | +0.7682% |
| 5 | Scorpio | +0.7171% |
| 6 | Aquarius | +0.7136% |
| 7 | Pisces | +0.7067% |
| 8 | Capricorn | +0.6938% |
| 9 | Sagittarius | +0.6896% |
| 10 | Libra | +0.6877% |
| 11 | Gemini | +0.6814% |
| 12 | Virgo | +0.6071% |

| August 20, 2003, Close | Place | PP | Gain |
|---|---|---|---|
| Final | 17505 | 56.2 | +0.7300% |
| High | 5956 | 85.1 | +0.9956% |
| Low | 24811 | 38.0 | +0.1618% |

| | | | |
|---|---|---|---|
| A | A | 9 | +0.7307% |
| B | B | 15 | +0.5785% |
| C | C | 7 | +0.7819% |
| D | D | 10 | +0.6827% |
| E | E | 8 | +0.7741% |
| F | F | 5 | +0.9174% |
| G | G | 13 | +0.6644% |
| abcdefg | | | +0.7300% |

| Sweep Word is teaching | | | |
|---|---|---|---|
| 10:00 | W | +0.0880% | +0.0804% |
| 11:00 | L | +0.4987% | +0.5001% |
| 12:00 | W | -0.0807% | -0.1014% |
| 1:00 | L | +0.1411% | +0.1538% |
| 2:00 | L | -0.1277% | -0.1190% |
| 3:00 | L | -0.0394% | -0.0350% |
| No Sweep Today :o( | | | |

| Round 3 - Complete | | |
|---|---|---|
| Place | Racer | Gain |
| 1 | fogsneaker | -0.0543% |
| 2 | walkonmars | -0.0739% |
| 3 | lovingodes | -0.0770% |
| 4 | evanosdell | -0.0777% |
| 5 | laceyundes | -0.0837% |
| 6 | melodiousj | -0.0849% |
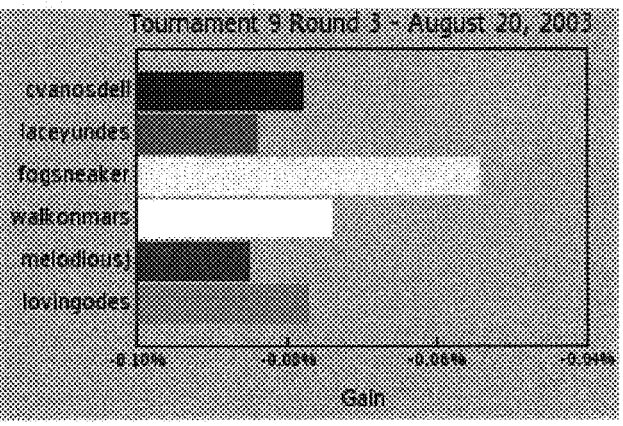
| Round 2 - Complete | | |
|---|---|---|
| Place | Racer | Gain |
| 1 | walkonmars | +0.5753% |
| 2 | mywausikit | +0.5544% |
| 3 | santacruzd | +0.5168% |
| 4 | davidmeadows | +0.5067% |
| 5 | mjicdancer | +0.5030% |
| 6 | jhindmarsh | +0.5019% |
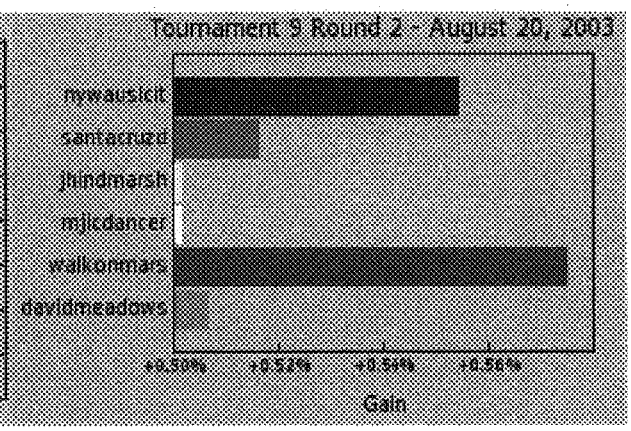
| Round 1 - Complete | | |
|---|---|---|
| Place | Racer | Gain |
| 1 | walkonmars | +0.1280% |
| 2 | charlesoei | +0.1265% |
| 3 | curtisbook | +0.1091% |
| 4 | comoptisyd | +0.0898% |
| 5 | buckwhead | +0.0883% |
| 6 | cuthoney | +0.0873% |
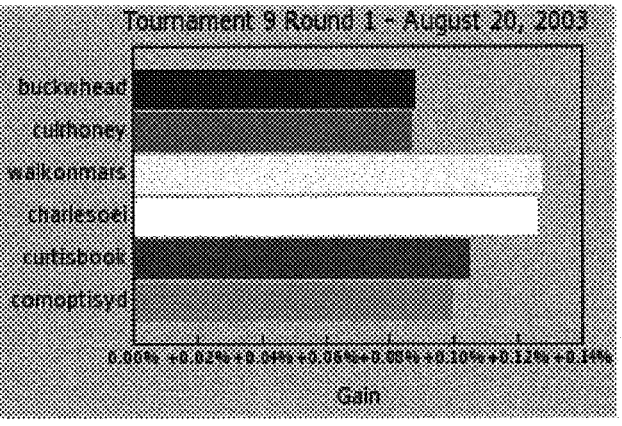
FIG. 30

GAME BASED UPON FLUCTUATIONS OF AN OBJECTIVE ENVIRONMENT

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

FIELD OF THE INVENTION

The present invention generally relates to a game that is based upon the fluctuations of arbitrary and objective data, and more specifically relates to a game that is based upon the fluctuations of openly traded instruments.

BACKGROUND OF THE INVENTION

While lotteries and games of chance are ubiquitous, they have changed little since their inception. A lottery, generally speaking, is a contest in which tokens are distributed or sold, and the winning token or tokens are predetermined or selected in a random drawing. A game of chance, generally speaking, is a game that is usually played for money or stakes, in which the winner is determined by a chance event, e.g., drawing numbers or throwing dice.

A quality of most lotteries and games of chance is that selection and communication of winning contest and lottery results are virtually instantaneous. Players of these games experience little suspense or engaging drama over a period of time as may be experienced when a bet is placed on a horse race or a sporting event. The length of excitement typically experienced by a lottery player is no longer than the period of time taken to read the winning results and to check these results against their tickets. The period of excitement typically experienced by a contest entrant is no longer than the length of time taken to learn whether they were the winning entrant, or in many cases, no time at all, if the entrant does not eventually seek out the information regarding the contest's winner, and instead, only hopes to be notified if they have been fatefully selected as the winner.

Moreover, many lotteries and games of chance involve placing a bet upon a token or number in which the player has no vested emotional interest. For example, a person who draws a number at random in a game of chance or who plays a state lottery using random numbers does not have a vested emotional interest in those numbers. While in some cases a player may play numbers in a lottery that represent something of value to the player, e.g., a birthday or an anniversary date, the vested emotional interest in the actual numbers themselves is low. The number of opportunities a lottery player has to create unique lottery tickets, each with vested emotional interest, is also low.

Moreover, while most lotteries and games of chance each share some characteristic that provides a degree of certainty that the lottery or game of chance cannot be fixed or outsmarted (i.e., the winner is left to chance), that same characteristic often hides much, if not all, of the details of how the winner was determined. For example, in order to ensure that the drawing of numbers from a hat is random (and presumably fair), one cannot view the positions of all the numbers in the hat one may choose from prior to selecting a number from the hat. In another example, in order to ensure the winning lottery numbers are randomly chosen, one may not observe the behavior of the numbered ping pong balls in the dispenser in which they are drawn over a prolonged length of time prior to buying a lottery ticket. While these characteristics help ensure the lotteries and games of chance are fair, they also disengage the player by hindering the player's ability to become emotionally invested in the process that determines the outcome of the game.

Accordingly, there is an unaddressed need in the art to provide an entertaining lottery or game of chance that overcomes the aforementioned problems associated with prior approaches.

SUMMARY AND ADVANTAGES

Thus, the objectives and advantages of the present invention include, but are not limited to, the following:

(a) to provide a scoring basis from which many entertainment, contest, wagering, and lottery based games can be played;

(b) to provide a game where an objective and measurable value can be calculated for each of a set of words, in order to determine a winning word among the set;

(c) to provide a display of variety of competitions between sets of letters and sets of words in order to provide entertainment to the public;

(d) to provide a lottery and contest mechanism wherein the determination of the winning results provides suspense over a period of time;

(e) to provide a lottery and contest mechanism using alphabetic characters as the items of selection, thus increasing the number of opportunities for each player can select entries that have vested emotional interest to the player;

(f) to provide a wagering, lottery, and contest mechanism using the alphabet as the items of selection, therefore providing player interest in following each events winning selections;

(g) to provide a lottery and contest mechanism wherein the result is derived from fluctuating objective values, therefore providing greater interest to the player;

(h) to provide contests where a sponsors brand name is a critical element of the game, therefore increasing the brands exposure and visibility to the player.

(i) to provide a viable lottery environment based on results of the stock market;

(j) to provide a viable wagering environment based on results of the stock market; and (k) to provide an interesting and amusing picture of the days stock market results, for those who follow stock market activity.

Further objects and advantages are to create a colorful, vibrant, and exciting electronic gaming environment wherein members of the general public may follow the current gamer results, play a variety of games, either alone or between friends, enter a variety of contests to win cash or prizes, place wagers on the games results, or play one of many lottery games. Still further objects and advantages will become apparent from a consideration of the ensuing description and drawings.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

The present invention is illustrated by way of example, and not by way of limitation, in the figures of the accompanying drawings and in which like reference numerals refer to similar elements and in which:

FIG. 12 is a pictorial representation of a table representing the performance values of group during each of the day Æs Hour Races according to an embodiment of the invention;

FIG. 14 is a pictorial representation of a table displaying data values pertinent to each item in a group according to an embodiment of the invention;

FIG. 15 is a pictorial representation of a table displaying leading selections of a contest according to an embodiment of the invention;

FIG. 16 is a pictorial representation of a table displaying leading selections of a Contest race with one unique indicia count according to an embodiment of the invention;

FIG. 17 is a pictorial representation of a table displaying leading selections of a City Race according to an embodiment of the invention;

FIG. 18 is a pictorial representation of a table displaying results of each group over a prior number of races according to an embodiment of the invention;

FIG. 19 is a pictorial representation of the results over a prior number of races according to an embodiment of the invention;

FIG. 20 is a pictorial representation of a table displaying a scatter table of group results over a prior number of races according to an embodiment of the invention;

FIG. 21 is a pictorial representation of table displaying the results of Hour Races over a prior period of days according to an embodiment of the invention;

FIG. 22 is a pictorial representation of table displaying the results of a Word Races contest over a prior period of days according to an embodiment of the invention;

FIG. 23 is a pictorial representation of table displaying the results of City Races over a prior period of days according to an embodiment of the invention;

FIG. 30 is a pictorial representation of a table and graph displaying results of a Tournament selection according to an embodiment of the invention.

DETAILED DESCRIPTION OF THE PREFERRED EMBODIMENT

Figure 1A:
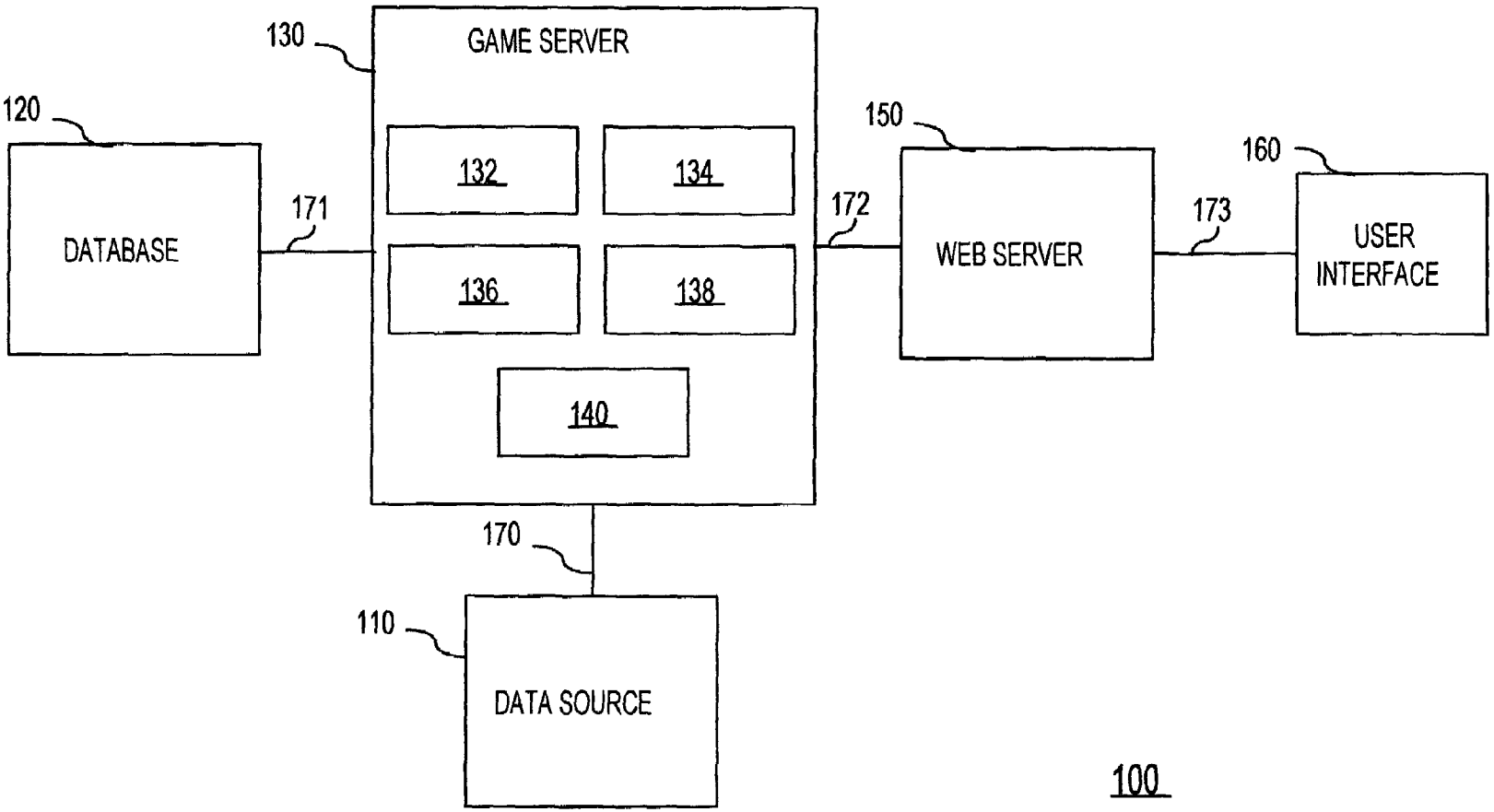
FIG. 1A is a block network diagrams illustrating a game system according to a first embodiment of the invention.

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

It will be understood that in the event parts of different embodiments have similar functions or uses, they may have been given similar or identical reference numerals and descriptions. It will be understood that such duplication of reference numerals is intended solely for efficiency and ease of understanding the present invention, and are not to be construed as limiting in any way, or as implying that the various embodiments themselves are identical.

A method and apparatus for playing a game is described. In the following description, for the purposes of explanation, numerous specific details are set forth in order to provide a thorough understanding of the present invention. It will be apparent, however, that the present invention may be practiced without these specific details. In other instances, well-known structures and devices are shown in block diagram form in order to avoid unnecessarily obscuring the present invention.

Functional Overview

A scoring method for games, hereinafter referred to as a race, is provided wherein unique indicia, e.g. a letter of the alphabet, are assigned to each member of a plurality of groups. Each group consists of a plurality of items that each have a data value that is objective, arbitrary, and that fluctuates over time, e.g., the items in each group and their data values may correspond to prices of openly traded instruments in the market. A performance value is determined for each group that reflects the change of data values of each item in the group between two points in time. A sequence of indicia is determined by ordering the groups from highest to lowest according to performance value. The game results are computed and displayed from a starting point in time until an ending point in time where the results of the race are verified and declared as official.

In one embodiment of the game method, a player makes of selection of one or more alphabetic characters to play in the game. For example, the player may select a word or phrase, which may correspond to the players name, family initials, nickname, online username, favorite sports team, or other chosen word or text. The player may make the selection electronically by submission through a displayed user interface. The player may enter a list of selections themselves or enter a single selection that is joined into a contest with selections submitted by other players. Each selection is then scored based on the performance values associated with the groups having unique indicia corresponding to each letter in the players selection. Selections that have achieve the highest or lowest scores among a group of selections at the ending point of a race are considered to be the winning selections.

Wagering and Lottery

In another embodiment of the game of the game method, a player selects makes of selection of a fixed number of group indicia. The player may also specify a wager type and submit a wager value with their selection. Winning selections comprise selections of indicia that correctly match the upper portion of the sequence of indicia at the ending point of a race. Payouts at prescribed or pari-mutuel odds may be paid to players with winning selections.

Players may play different types of games according to various embodiments of the game. The player may play alone or with other players. Players may play a selection in a contest, or may play a selection in a variety of other games. The player may play the game anytime that arbitrary and objective data is available, or the player may play in a contest by submitting their selection before the contest begins.

Architecture Overview

Figure 1B:
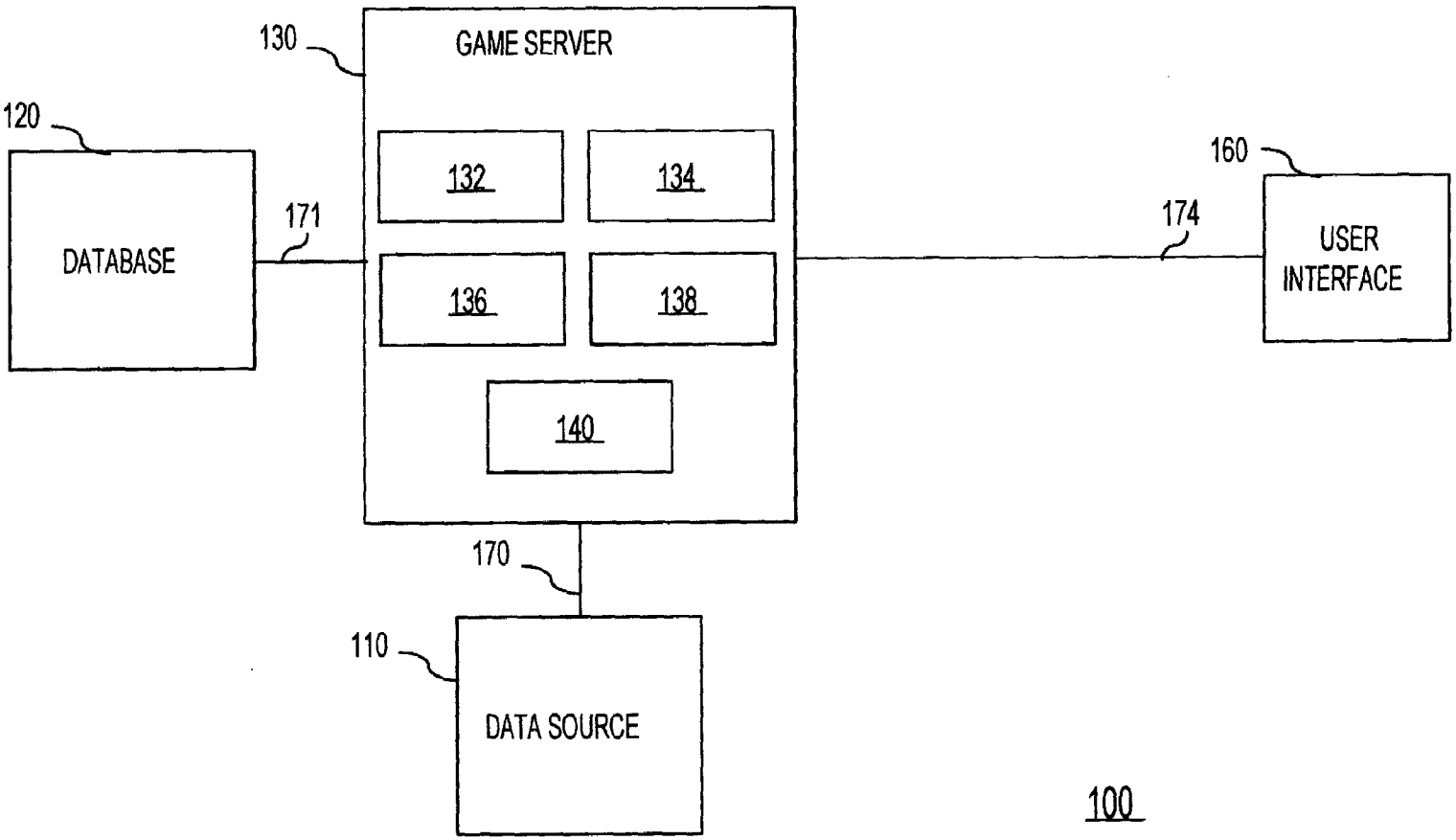
FIG. 1B is a block network diagrams illustrating a game system according to a second embodiment of the invention.

FIGS. 1A and 1B are block network diagrams illustrating a game system 100 according to an embodiment of the invention. The game system 100 of FIG. 1A includes data source 110, database 120, game server 130, web server 150, user interface 160, and communications links 170, 171, 172, 173, and 174.

Data source 110 is used broadly to refer to any source that may supply data about a series of arbitrary and objective events, such as, e.g., data about openly traded instruments. For example, data source 110 can be implemented by querying the information from published sources on the Internet, or by real-time data feeds supplied by commercial vendors.

For ease of explanation, embodiments of the invention shall be discussed in which data source 110 supplies information about openly traded instruments, such as, without limitation, information about openly traded stocks, bonds, mutual funds, commodities, securities, warrants, trust certificates, and derivatives. Information about openly traded instruments may originate from any market, e.g., a domestic market, such as NASDAQ, or a foreign market. However, data source 110 may supply information about any series of arbitrary and objective events that yields a flow of information on a continual basis. For example, in other embodiments, data source 110 supplies information about temperatures in various locations and information about sport or game statistics.

Database 120 is used broadly to refer to any database or similar mechanism for reliably storing electronic information on persistent storage devices. Database 120 may be used to store game data, including, but not limited to, data obtained from data source 110 and data about players and their game selections.

Game server 130 is used broadly to refer to any server that performs services to support game processes. In the embodiment depicted in FIG. 1A, game server 130 comprises a update component 132, a race subcomponent 134, a contest subcomponent 136, a display subcomponent 138, and an interface subcomponent 140

While embodiments depicted in FIG. 1A and 1B depict game server 130 comprising a update component 132, a race subcomponent 134, a contest subcomponent 136, a display subcomponent 138, and an interface subcomponent 140, other embodiments of the invention may combine the functionality of one or more subcomponents into a single subcomponent. Further, for ease of explanation, subcomponents 132 û140 are illustrated as residing on a single game server; however, for scalability purposes, it would be advantageous to deploy multiple game servers and/or deploy multiple instances of subcomponents 132 û140.

Update component 132 is a computerized entity, such as a computer program, that is capable of updating the composition of items in each group. The length of time between updating the composition of each group is referred to as the update period. Update component 132 may be configured to update the set of items in each group at specified times, e.g., every Friday at 5:00 PM or after the expiration of a length of time, such as a week or calendar month. After update component 132 has updated the set of items in each group, the list of items in each group may be made publicly available to players, e.g., by publishing the list of items on a web page.

Figure 2:
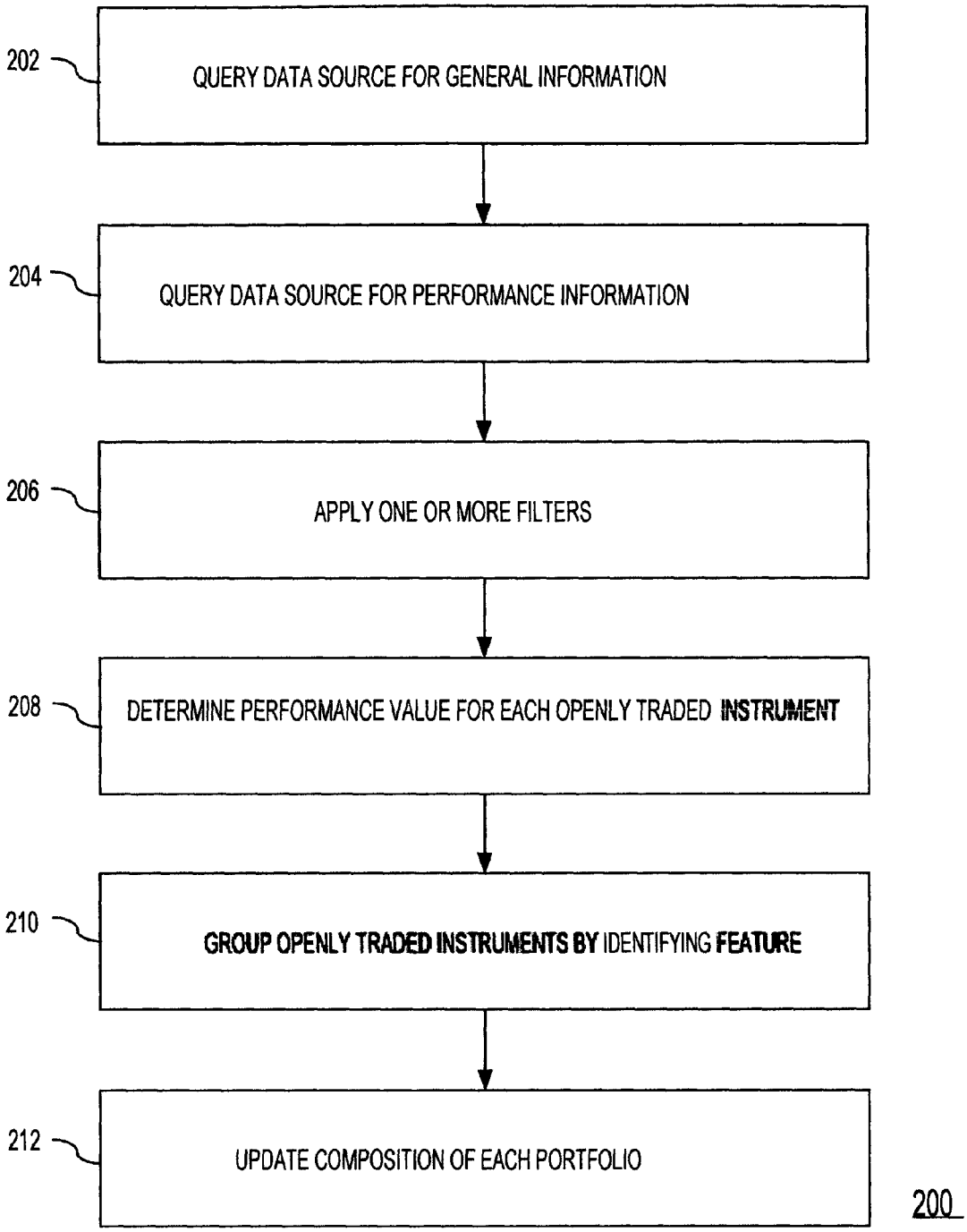
FIG. 2 is a flow chart illustrating the steps of updating the set of items in each group according to an embodiment of the invention.

The process performed by update component 132 in updating the set of items in each group, according to an embodiment wherein each item in each group corresponds to an openly traded instrument, shall be described with reference to flow chart 200 of FIG. 2. In step 202, the update component 132 queries the data source 110 for general information about all openly traded instruments. Examples of the type of general information obtained in step 202 include, without limitation, information about the openly traded instruments name and corresponding company, location of headquarters of corresponding company, market which instrument is traded on, industry sector, market cap, beta, and type of openly traded instrument (for example, common stock, trust certificate, warrant, or preferred stock). As a result of performing step 202, a complete list of openly traded instruments available for inclusion in game system 100 is obtained.

In step 204, the update component 132 queries data source 110 for performance information about each openly traded instrument over the previous update period. Performance information includes any statistical information characterizing the daily performance of each openly traded instrument in the market, including price and volume information. In step 204, performance information is obtained for each openly traded instrument in which general information was obtained for in step 202.

In step 206, a set of one or more filters is applied to the set of openly traded instruments that the data source 110 has supplied information for in steps 202 and 204. Each of the one or more filters may eliminate a particular openly traded instrument from further consideration if one or more conditions checked by the filter are satisfied. This step is useful to ensure that each openly traded instrument in each group is within prescribed windows related to size and stability. For example, a particular filter may remove an openly traded instrument from further consideration if one or more of the following conditions are satisfied: (a) the current or average price is below a specified threshold, (b) the average volume over the previous period is below a certain threshold, (c) the number of days over a previous period where the volume is below a certain threshold, (d) the number of days of prior trading data is below a specified threshold, (e) the stocks beta is above or below a certain threshold (f) the security type is on an unaccepted list, (g) the stock ticker symbol contains non-alphabetic characters, or (h) delinquent status by the SEC,. The one or more filters applied in step 206 may be configured to check for any condition, i.e., the above conditions are merely illustrative.

In step 208, a past performance value is determined for each openly traded instrument that has not been eliminated from inclusion by a filter during step 206. In an embodiment, the past performance value is computed by calculating the average volume of the openly traded instrument. Other embodiments may determine the past performance value of the openly traded instruments using other algorithms, e.g., in another embodiment the past performance value of an openly traded instrument may be calculated by determining the market capitalization of the openly traded instrument.

In step 210, the openly traded instruments still being considered are grouped according to an identifying feature associated with each of the openly traded instrument. For example, in an embodiment, the openly traded instruments are grouped according to the first letter of an associated ticker symbol. Other embodiments may group openly traded instruments according to other identifying features, e.g., the first letter of the name of the openly traded instrument, or the first letter of the city where the corporation headquarters is located.

In step 212, the composition of each group is updated to include a configurable number of openly traded instruments that each share an identifying feature with the letter associated with the group in which the openly traded instrument is a member. In an embodiment, each group contains an equal number of openly traded instruments.

The number and composition of items in each group should equalize, as best possible, the variance and size of the collective performances of each group's items. In an embodiment, indicia may be combined to accommodate certain indicium that has a low quantity of items. For example, in an embodiment, groups that have an identifying feature associated with K, Q, X, Y, and Z may be paired with other letters of the alphabet because of the limited number of openly traded instruments that start with those letters.

In an embodiment, a number of openly traded instruments with past performance values closest to a most desirable value are selected for inclusion within the group. In an embodiment, an administrator of game system 100 may select the openly traded instruments included within each group. In selecting each openly traded instrument for inclusion within a group, the administrator should attempt to balance volatility, volume, and sector orientation to select an evenly balanced set of openly traded instruments per group.

In an embodiment, each group is updated to include a configurable number of openly traded instruments in step 212. For example, each group may be updated in step 212 to include 100 openly traded instruments in an embodiment. A limited number of instruments beyond the number included in the group may be designated as backup instruments should any of the instruments included in the group no longer be active due to situations such as mergers, bankruptcies, and delistings.

The steps discussed above with respect to flow chart 200 are merely illustrative of one embodiment; other embodiments of the invention may perform the sequence of steps illustrated in flow chart 200 in parallel or a different order, e.g., steps 202 and 204 may be performed in reverse order or in parallel. Consequently, embodiments of the invention are not limited to the specific sequence of steps illustrated in FIG. 2.

Race subcomponent 134 is a computerized entity, such as a computer program, that is capable of retrieving information from data source 110 and storing data in database 120. Race subcomponent 134 retrieves data about each item in each group from data source 110, and stores the retrieved data in the database 120. Race subcomponent 134 may operate anytime that new or additional data is available about items from data source 110. Race data is data obtained from data source 110 that relates to or supports a race or contest, and includes data that may be used to evaluate the performance of an openly traded instrument, such as price and volume data. Races and contests are described in further detail in the section entitled Game Operation.

Figure 3:
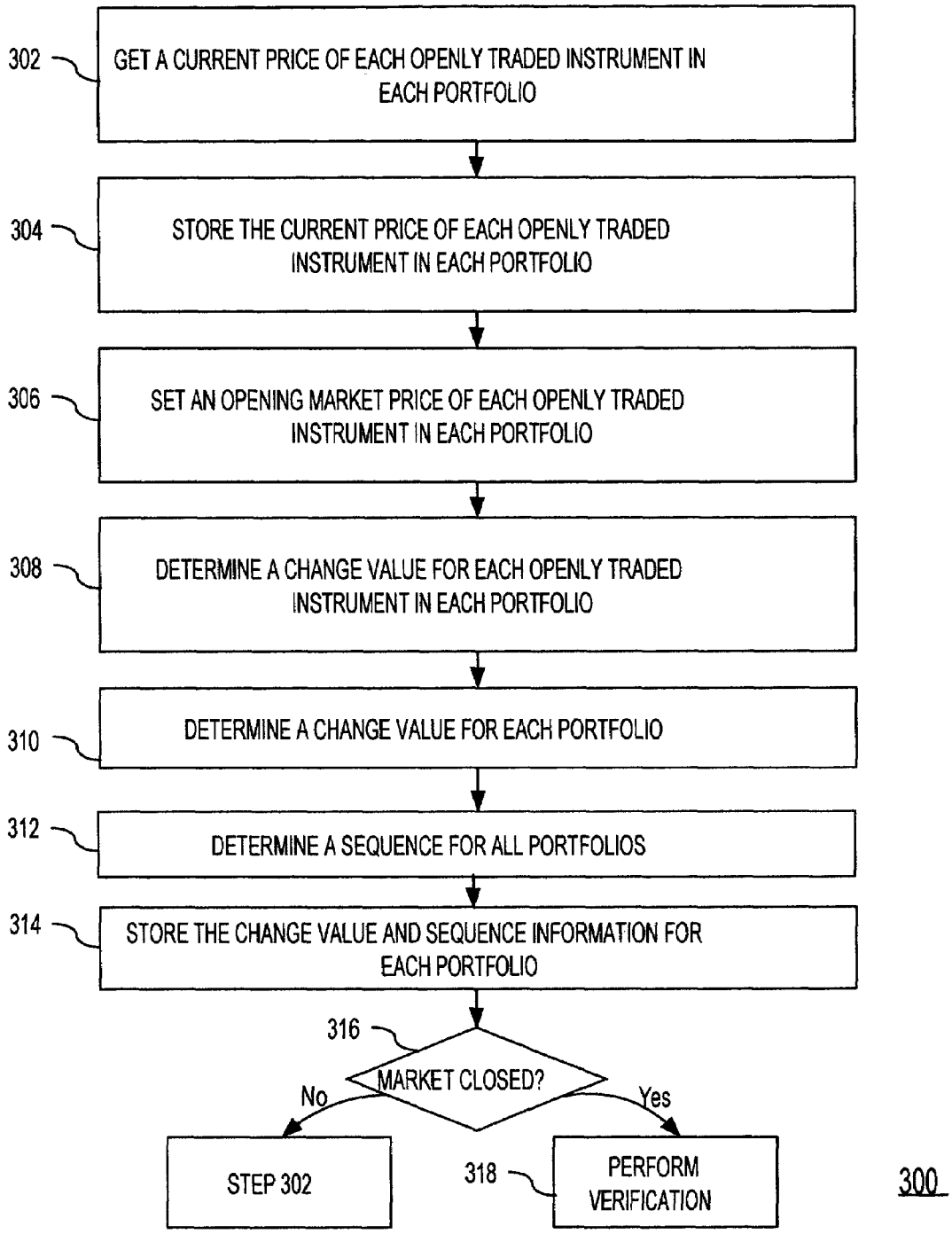
FIG. 3 is a flow chart illustrating the steps performed by the race subcomponent according to an embodiment of the invention.

The steps performed by race subcomponent 134, according to an embodiment of the invention wherein each item in each group corresponds to an openly traded instrument, shall now be described with reference to flow chart 300 of FIG. 3. In an embodiment, race subcomponent 134 repeatedly performs the steps illustrated in flow chart 300 as often as possible. An administrator to game system 100 may configure the rate at which race subcomponent 134 performs the steps illustrated in flow chart 300, or it may be dynamically configured based upon current network conditions between game server 130 and data source 110.

In step 302, the current price of each openly traded instrument currently assigned to a group is queried from data source 110. In step 304, the current price of each openly traded instrument that was obtained in step 302 is stored in the database 120. In an embodiment, if the current price of a particular openly traded instrument may not be obtained from data source 110, then the current price of another openly traded instrument in a backup list may be obtained, and that openly traded instrument may be used in place of the particular openly traded instruments whose current price could not be obtained.

In step 306, an opening price is established for the current day for each openly traded instrument in each group. In one embodiment, the opening price for an openly traded instrument is established using price information about the first trade of that openly traded instrument for the day or time interval. In another embodiment, the opening price for a particular day of an openly traded instrument is the price held by the openly traded instrument when the market opened that day. Step 306 may need only be performed once a day or game period.

In step 308, a change value is computed for each openly traded instrument in each group. In an embodiment, the change value is the percentage change from the item's opening price to its current price. For example, the change value of an openly traded instrument is the percentage change of the openly traded instruments opening price to a current price of the openly traded instrument. In such an embodiment, closing prices for each openly traded instrument are stored in database 120.

In step 310, the set of change values associated with each openly traded instrument in each group are averaged to determine a performance value for the group. In an embodiment, the change value of each openly traded instrument in a group may be assigned equal weight in determining the change value of the group. Other embodiments may assign a greater weight to certain openly traded instruments within a group when determining the performance value of the group.

In step 312, a sequence of the plurality of groups based upon the performance value for each group the game period is determined. For example, the group associated with the largest change value would be assigned a rank of "1", indicating that it is in first place (i.e., no other group is outperforming it), the group associated with the next largest change value would be assigned a rank of "2", and so on. Accordingly, in step 312, the plurality of groups are arranged in a sequence based upon the performance value of each group, and each group is assigned a rank that determines the groups relative position in the sequence of groups. In step 314, the change value, the sequence of groups, and the rank associated with each group are stored in database 120.

In step 316, a determination is made as to whether a race has ended since the last time a verification process has been performed. If there has not been a race that has ended since the last time a verification process has been performed, then processing proceeds to step 302. If there has been a race that has ended since the last time a verification process has been performed, then processing proceeds to step 318.

In step 318, in an embodiment, a verification process is performed. The verification process verifies data values of trades surrounding a races opening time and closing time, to ensure that a data transmission error does not cause an incorrect result of the current race. The process of verification is also intended to address the possibility that an outside influence on the game could affect the outcome of the game by executing small trades of openly traded instruments abnormally above or below an openly traded instrumentsÆ current market price. When a race opens or closes, trades for each openly traded instrument are compared against their previous or subsequent trade. In an embodiment, if the number of shares of a trade is below a certain configurable threshold and the trade causes the openly traded instrument to change in value beyond a configurable threshold, then that particular trade may be ignored. Some embodiments of the invention only perform the verification process of step 318 at or near the beginning or end of a race. Other embodiments of the invention may not perform step 318.

In an embodiment, the steps discussed above with respect to flow chart 300 are continually repeated while data source 110 provides new or updated data about each item in each group. For example, in an embodiment, race process 134 performs the steps of flow chart 300 at all times when the market is open. Other embodiments of the invention may perform the steps of flow chart 300 at all times when the market is open, and may perform the steps during a configurable time window prior to the market opening and after the market closes to ensure that all race data is collected by race process 134.

The steps discussed above with respect to flow chart 300 are merely illustrative of one embodiment; other embodiments of the invention may perform the sequence of steps illustrated in flow chart 300 in parallel or a different order. Consequently, embodiments of the invention are not limited to the specific sequence of steps illustrated in FIG. 3.

Contest subcomponent 136 is a computerized entity, such as a computer program, that is capable of updating contest data stored in database 110. Contest data refers to any data that relates to or supports a contest. Contests are described in further detail in the section entitled Game Operation.

Figure 4:
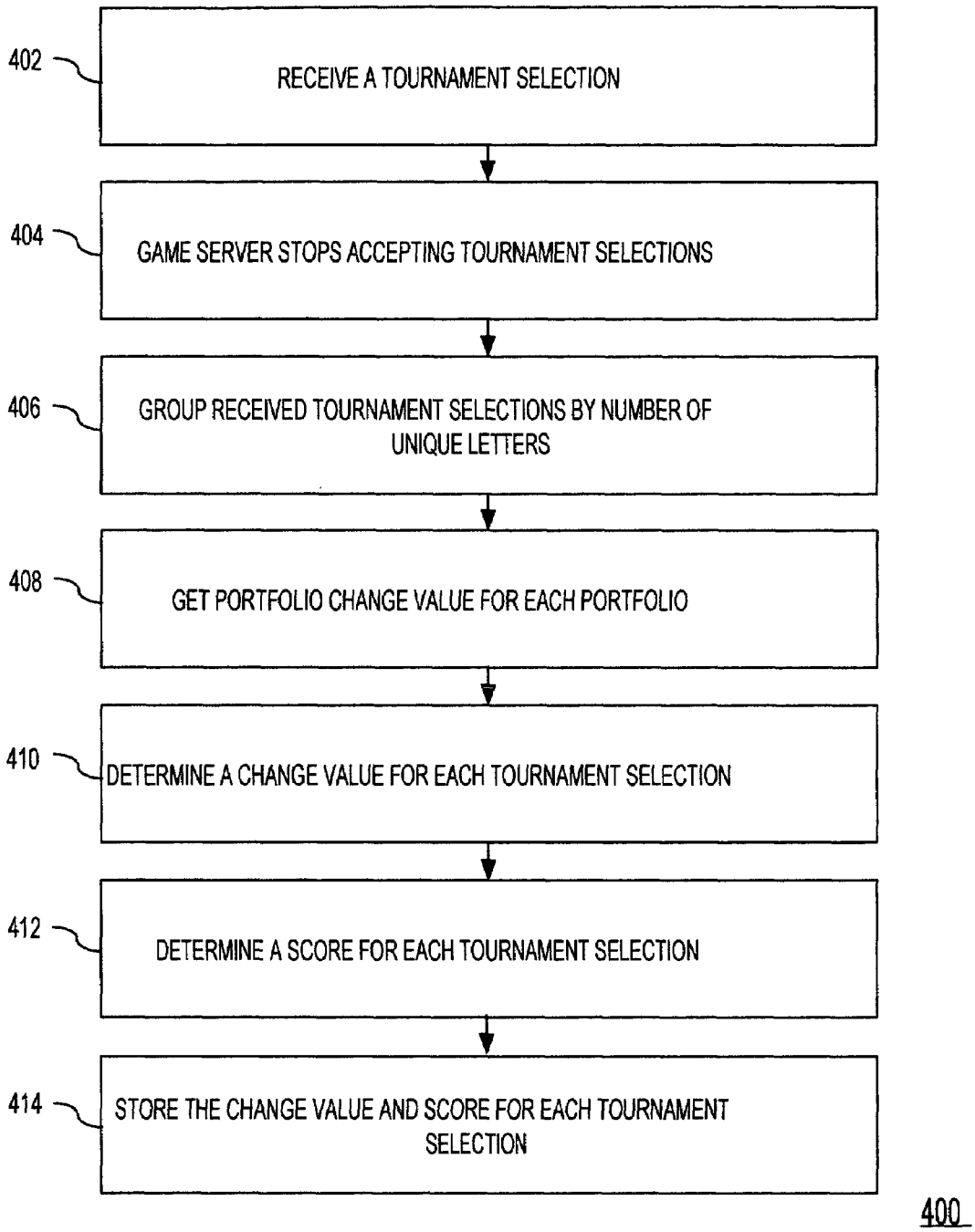
FIG. 4 is a flow chart illustrating the steps performed by the contest subcomponent according to an embodiment of the invention.

The steps performed by contest subcomponent 136, according to an embodiment of the invention wherein each item in each group corresponds to an openly traded instrument, shall now be described with reference to flow chart 400 of FIG. 4. In step 402, prior to the market opening on a particular day, game server 130 may receive a contest play selection (hereinafter a "contest selection") submitted by a player for that particular day. The contest selection comprises one or more characters. In an embodiment, a playerÆs contest selection may be entered through user interface 160.

In step 404, game server 130 ceases to accept playerÆs selections for contest play for that particular day. In an embodiment, the contest for a particular day is closed once the market opens for that day. However, game server 130 may continue to receive and accept player selections for contest play for future days, as the market has not opened for those days. In another embodiment, the contest for a particular day may close a configurable time prior to the market opening for that day. Races and contests are described in further detail in the section entitled "Game Operation In step 406, all contest selections submitted by players for that day are divided into groups according to the number of unique letters in each selection. In step 408, the group change value associated with each group that was stored in step 314 is queried from the database 120. In step 410, a score is determined for each contest selection. In an embodiment, the score for each contest selection is computed by averaging the performance value of each group (determined in step 310) associated with the unique indicia (e.g., a letter) that correspond to one of the unique letters in the contest selection. For example, for a contest selection of "Matt", because the word "Matt" has three unique letters, the score of the contest selection may be determined by averaging the performance value of the groups associated with unique indicia that correspond to the letters "M", "A", and "T" In another embodiment, wherein a single group is associated to unique indicia corresponding to both the letter "J" and "K" the change value of the contest entry of "JACK" may be determined by averaging the performance value of three groups, namely the groups whose unique indicia correspond to the letters K, A, and C. In step 412, the set of contest selections are sorted by their score to determine a place value for each contest selection, wherein the place value of each contest selection determines the relative position of that contest selection compared to the other contest selections. In step 414, the place value and score associated with each contest selection is stored in the database 120.

In an embodiment, steps 408, 410, 412, and 414 are continually repeated as long as the steps of flow chart 300 are repeated. The steps discussed above with respect to flow chart 400 are merely illustrative of one embodiment; other embodiments of the invention may perform the sequence of steps illustrated in flow chart 400 in parallel or a different order. Consequently, embodiments of the invention are not limited to the specific sequence of steps illustrated in FIG. 4.

Display subcomponent 138 is a computerized entity, such as a computer program, that is capable of creating displayable content. The range of displayable content which display subcomponent 138 includes any content that may be displayed on user interface 160, such as, for example, graphs, tables, and displayable pages.

Display subcomponent 138 may query data from database 120 or data source 110 when creating displayable content. In an embodiment, the displayable content created by display subcomponent 138 may be stored on game server 130. In other embodiments, the displayable content created by display subcomponent 138 may be stored on database 120.

Statistical reports may be created to support any race or contest. In an embodiment, the statistical reports may be created by display subcomponent 138 in a graphical format. Display process 138 continually queries database 120 for data to create displayable content as long as data source 110 is capable of supplying fresh data. For example, in an embodiment, while the stock market is open, display process 138 continually queries database 120 for data to create displayable content.

Figures 5, 6:
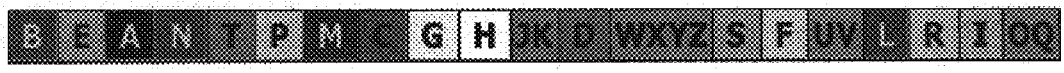
FIG. 5 is a pictorial representation of a bar diagram displaying the current ranking of each group according to an embodiment of the invention.
FIG. 6 is a pictorial representation of a table displaying the place value and performance value of each group according to an embodiment of the invention.
Figure 7:
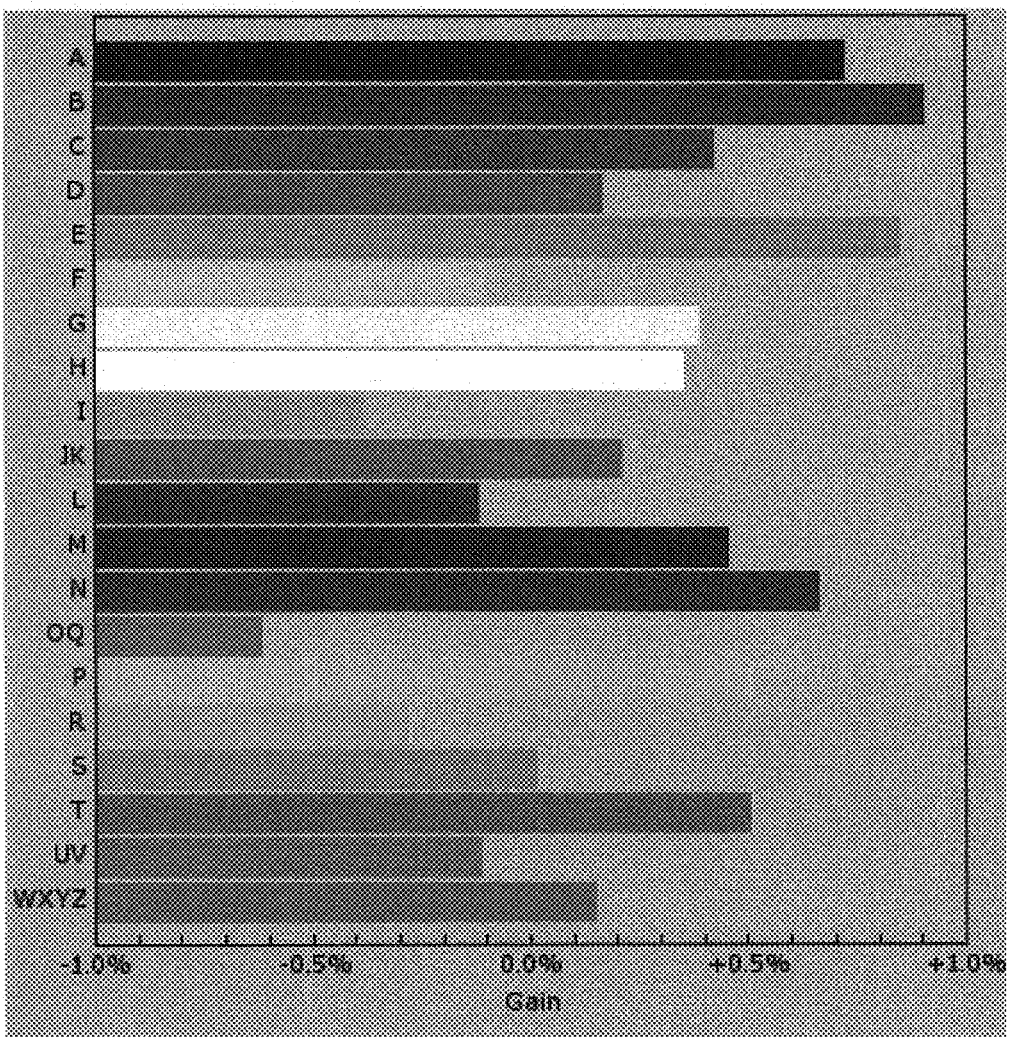
FIG. 7 is a pictorial representation of a bar graph that highlights all groups according to an embodiment of the invention.
Figure 8:
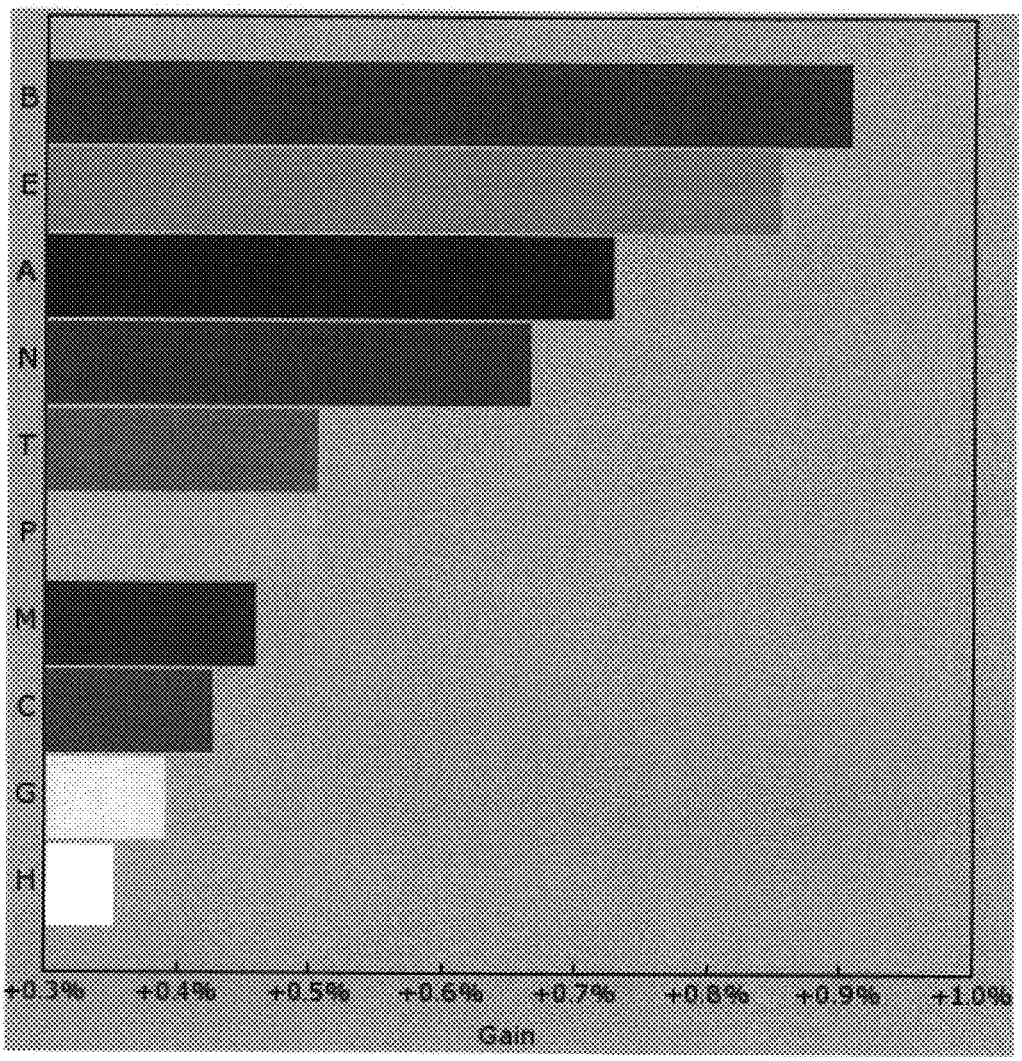
FIG. 8 is a pictorial representation of a bar graph that highlights the top ten groups according to an embodiment of the invention.
Figure 9:
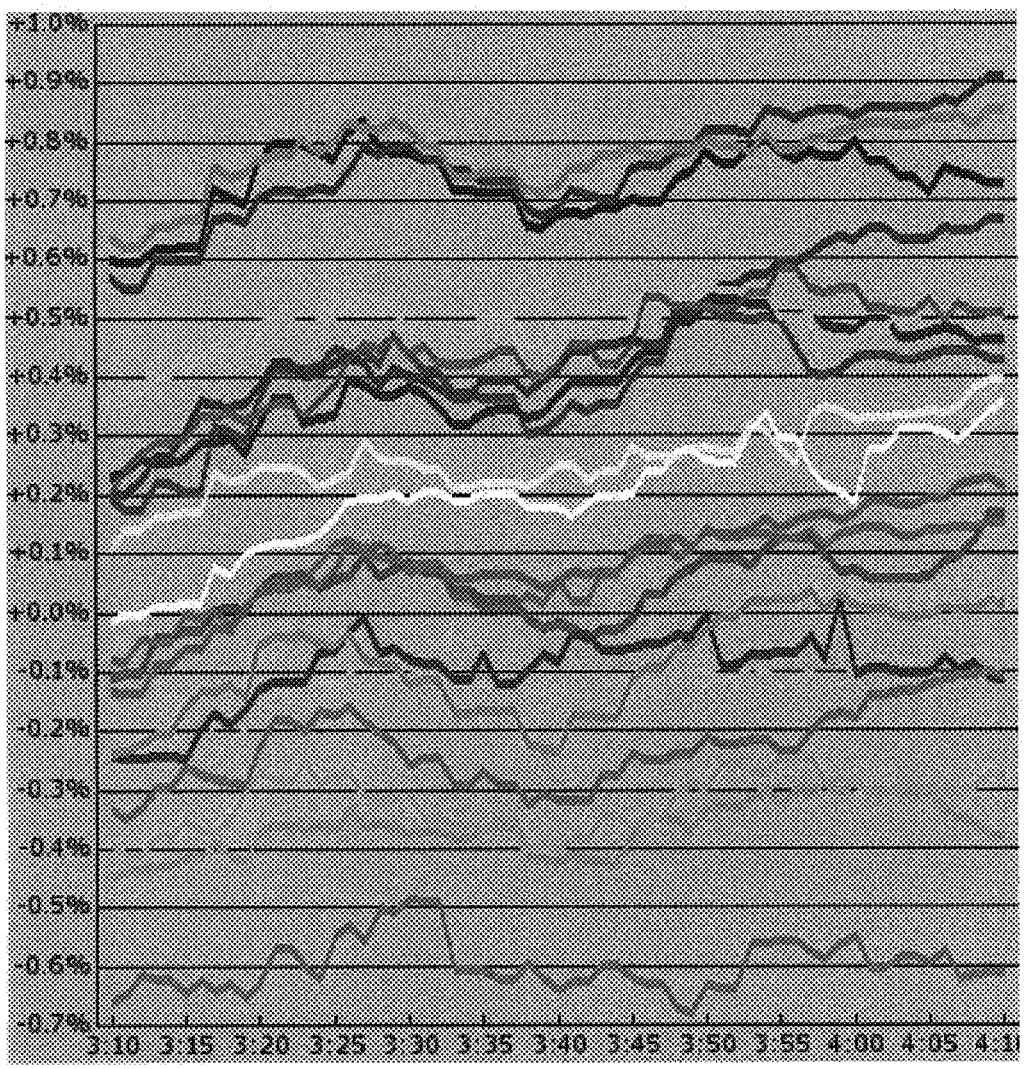
FIG. 9 is a pictorial representation of a line graph that highlights the movement of the performance values of each group over the last hour according to an embodiment of the invention.
Figure 10:
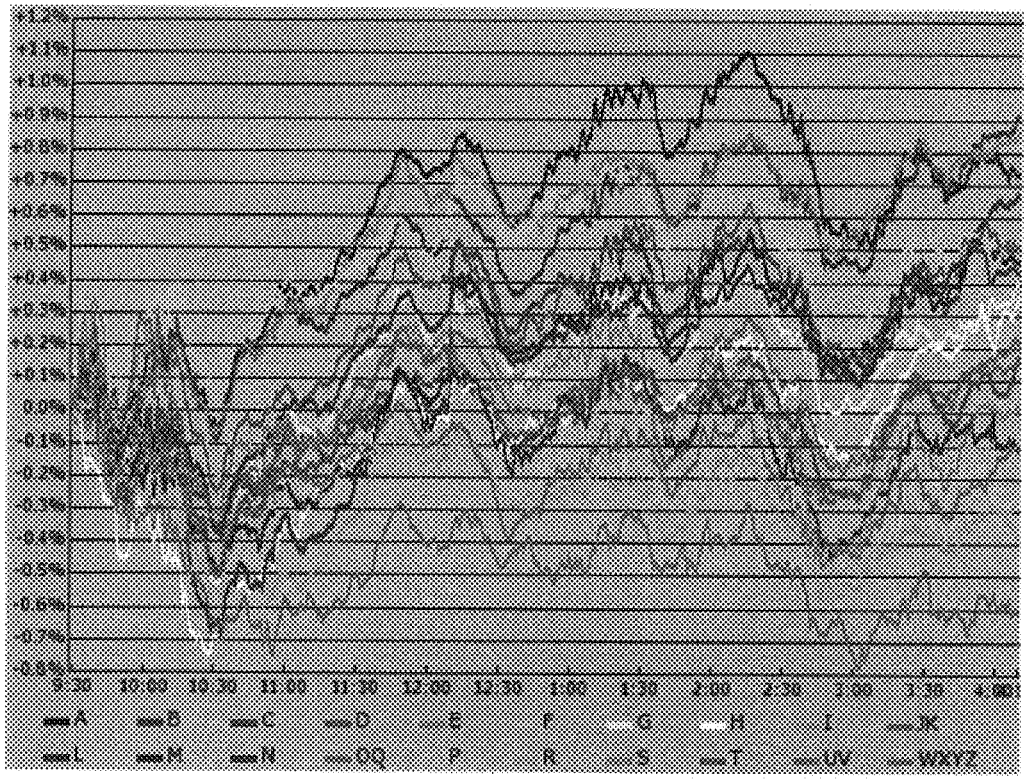
FIG. 10 is a pictorial representation of a line graph that highlights the movement of the performance values of each group over the entire day according to an embodiment of the invention.
Figure 13:
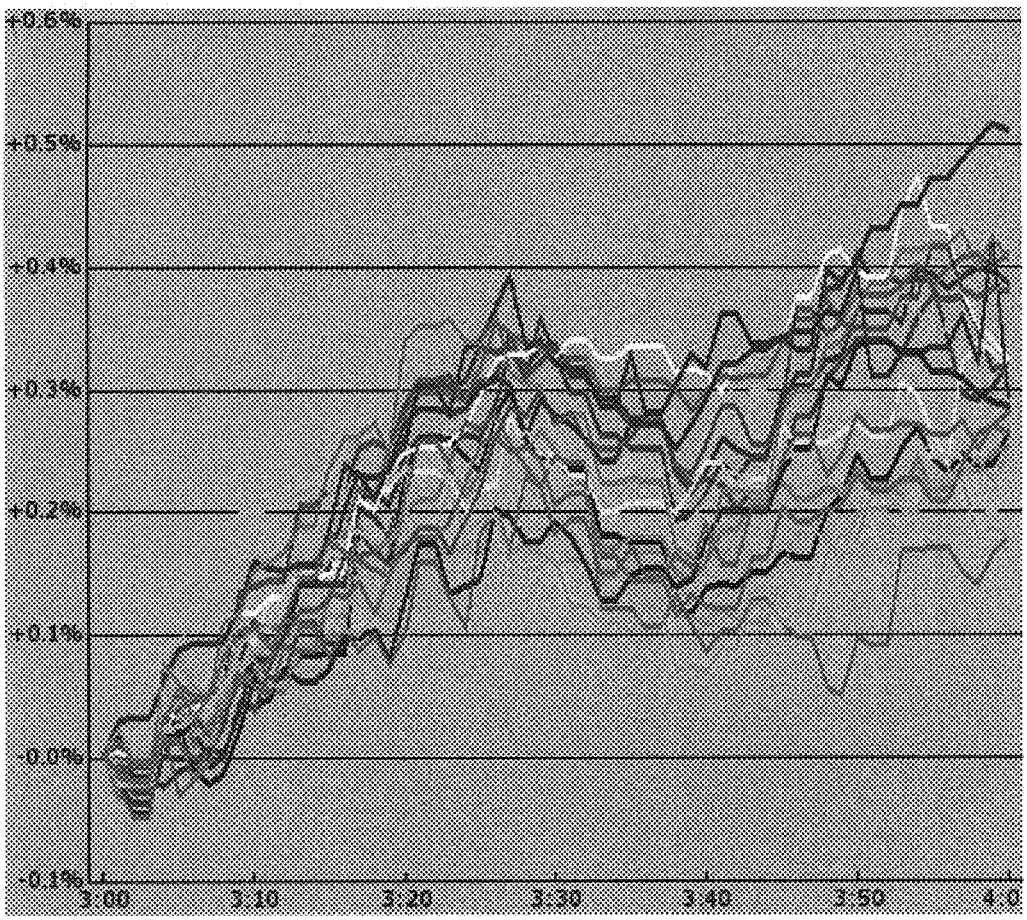
FIG. 13 is a pictorial representation of a line graph that highlights the movement of the performance values of each group over an Hour Race according to an embodiment of the invention.

In an embodiment, display process 138 continually creates one or more of the following graphics with data queried from database 120 or data source 110: (a) a horizontal bar displaying the current relative position of each group based upon performance value, as shown in FIG. 5, (b) a table displaying the change value of each group, as shown in FIG. 6, (c) a bar graph displaying the performance value of each group, as shown in FIG. 7 (d) a bar graph displaying the change of the top ten groups in order of their relative position based on performance value, as shown in FIG. 8, (e) a line graph displaying the change of movement in the performance values in each group for the last hour, as shown in FIG. 9, (f) a line graph displaying the change of movement in the performance values in each group over the entire day, as shown if FIG. 10, (g) a horizontal bar displaying the wining groups for each of a day Æs hour races, as shown in FIG. 1, (h) a table displaying the results of one or more hour races, as shown if FIG. 12, and (i) a graph displaying the change in movement of a race over each hour, as shown in FIG. 13 and (j) a graph displaying the change in movement of a race over an hour and (j) a table displaying each openly traded instrument within a group, including data values such as its relative position among all instruments used in all groups when ordered by change value, the previous close value for the openly traded instrument, the opening price of the openly traded instrument, the last sale of the openly traded instrument, the price change of the openly traded instrument, the change value of the openly traded instrument, and volume of the openly traded instrument, as shown in FIG. 14.

In an embodiment, display process 138 continually creates one or more of the following graphics with data queried from database 120 or data source 110: (a) a table displaying the leading players and losing players of a contest having multiple unique indicia count, as shown in FIG. 15, (b) a table displaying the leading players and losing players of a contest having a single unique indicia count, as shown in FIG. 16, and (c) a table displaying the leading cities and losing cities of a city race, as shown in FIG. 17.

In an embodiment, display process 138 continually creates one or more of the following graphics with data queried from database 120 or data source 110: (a) pari-mutuel odds to be paid for each indicia for various wagers and (b) a current estimation of a lottery jackpot size.

In an embodiment, display subcomponent 138 may create one or more of the following statistical reports of information regarding race or contest results over the last X number of days: (a) a table displaying statistics reflecting how each group has performed over the prior period, as shown in FIG. 18, (b) a table displaying daily results of the final sequence of indicia, as shown in FIG. 19, (c) a table describing the number of times each group finished in each place relative to other group, as shown in FIG. 20, (d) a table displaying results of each of the dayÆs hour races, as shown in FIG. 21, (e) the winners of daily contests, as shown in FIG. 22, and (f) the winners of city races, as shown in FIG. 23.

The above examples of graphics created by display process 138 are merely illustrative of an embodiment; display process 138 may create any graphics using data stored in database 120 or data obtained from data source 110.

Figure 11:
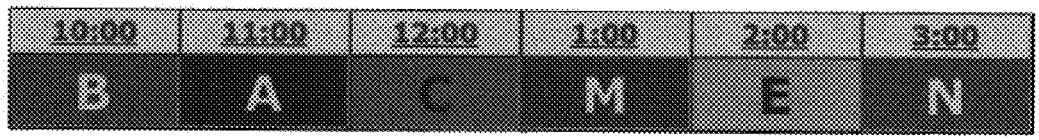
FIG. 11 is a pictorial representation of a bar diagram representing the winners of each of the day Æs Hour Races according to an embodiment of the invention.

Interface subcomponent 140 is a computerized entity, such as a computer program, that is capable of assembling the displayable content created by display process 138 and generating one or more screens for display on user interface 160. In the embodiment depicted in FIG. 1A, interface subcomponent 140 generates a web page for display on the user interface 160. In the embodiment depicted in FIG. 11B, interface subcomponent 140 generates a screen for display on the user interface 160.

In creating a web page or screen for display on user interface 160, if the request is for a standard request of race or contest information, displayable content created by display process 138 is used to create the display. If a request is made for unique information that has not been created by display process 138, then interface subcomponent 140 may create the required display content, as explained above. In other words, interface subcomponent 140 has access to the same graphical creation tools to which display subcomponent 138 has access; however, it is advantageous for performance reasons for display subcomponent 138 to create the display content for frequently requested displays as to minimize the time and resources required of interface subcomponent 140 in responding to a request for a web page or screen for display on user interface 160.

Web server 150 is used broadly to refer to any web server capable of serving web pages in response to requests to or for web pages. Web server 150 may be used provide information to user interface 160 when user interface 160 is implemented on a web browser, such as in FIG. 1A. For example, web server 150 may be implemented using the Apache web server, which is an open-source web server available from The Apache Software Foundation. However, if user interface 160 is not implemented on a web browser, as shown in FIG. 1B, then web server 150 is not required in game system 100.

User interface 160 is used broadly to refer to any user interface that an end user of game system 100 (referred to herein as a "player") may interact with game server 130 and upon which graphical information may be displayed. For example, user interface 160 may include, without limitation, a web browser, a touch screen, a television screen, a Palm pilot or other PDA, a personal computer such as including a monitor, keyboard and mouse, a cellular telephone display, a pager, an electronic ticketing device, and a screen displayable in a kiosk or other standalone terminal. For ease of explanation, only one user interface is displayed on FIG. 1A and FIG. 1B; however, embodiments of game system 100 may employ any number of user interfaces.

User interface 160 may be displayed on a web browser, although it need not be. For example, FIG. 1A depicts an embodiment of game system 100 wherein user interface 160 is displayed on a web browser, while FIG. 1B depicts an embodiment of game system 100 wherein user interface 160 is not displayed on a web browser. As shown in FIG. 1A, if user interface 160 is implemented on a web browser, then user interface 160 communicates over communication link 163 to web server 150. As shown in FIG. 1B, if user interface 160 is not implemented on a web browser, then user interface 160 communicates over communication link 164 to game server 130.

Communications links 170-174 may be implemented by any medium or mechanism that provides for the exchange of data between data source 110, database 120, game server 130, web server 150, and web browser 160. Examples of communications links 170, 171, 172, 173, and 174 include, without limitation, a network such as a Local Area Network (LAN), Wide Area Network (WAN), Ethernet or the Internet, or one or more terrestrial, satellite or wireless links.

Game Operation

An embodiment of the game described herein is referred to as "Stock Market Races.ö At regular interval, such as a week or month, a configurable number of securities are arranged into a configurable number of groups, each referred to as a portfolio. Each security within a group has an identifying feature that corresponds to a unique indicia associated the portfolio.

Prior to playing a game of Stock Market Races, one or more openly traded instruments are arranged into portfolios. In an embodiment, a configurable number of openly traded instruments are included in each portfolio. Each portfolio is associated with unique indicia. For example, in an embodiment, each portfolio is associated with a unique letter of the alphabet. In another embodiment, a portfolio may be associated with more than one letter of the alphabet. For example, in an embodiment, twenty portfolios are associated with the following portfolios of unique indicia: "A", "B", "C", "D", "E", "F", "G", "H", "I", "JK", "L", "M", "N", "OQ", "P", "R", "S", "T", "UV", and "WXYZ". For example, the portfolio associated with the letter "A" consists only of securities whose ticker symbol begins with the letter "A" and represents the letter "A" in word based contest games. The portfolio associated with the letters "WXYZ" consists only of securities whose ticker symbol begins with the letters "W", "X", "Y", or "Z" and represents the letters "W", "X", "Y", and "Z" in a selection.

Stock Market Races may be held over a variety of time periods, with each race having an explicit opening time and a closing time. Races, hereinafter referred to as a "Daily Race", are conducted over a single day from when the market opens to when the market closes. Other races may be held through the day or week in various intervals when the market is open. For example, in one embodiment, six races with a one hour duration, hereinafter referred to as "Hour Races", begin at 10:00 AM, 11:00 AM, 12:00 PM, 1:00 PM, 2:00 PM, and 3:00 PM and last for exactly one hour. In another embodiment entitled "Weekly Race", races may be held over the week, e.g., a race may cover Monday's opening market price to Friday closing price. In another embodiment entitled "Quick Race", a race may be conducted upon request by a player over a configurable time periods, e.g., for any period starting at random time X and for duration Y. In an embodiment, before-hours and after-hours market activity is not included in the game due to low trading volumes and news announcements, such as upgrades, downgrades, and earnings reports, that frequently occur during these periods.

Change values are calculated for each openly traded security included in each portfolio as the percentage change of price between the races opening time and a current time. Performance values for each portfolio are calculated as the average change value of all securities within the portfolio. Net performance values for each portfolio are also calculated as the portfolioÆs performance value minus average performance values of the plurality of portfolios. Performance values or Net performance values are used as the scoring mechanism for a set of games and contests hereinafter referred to as "Word Races" games.

Place values for each portfolio are calculated by ordering the portfolios from highest to lowest according to performance value. The sequence of indicia produced by the ordering of portfolios from highest to lowest is used as the basis for determination of winning selections within games and races hereinafter referred to as "Wagering Games".

Players submit Stock Market Races game selections composed of one or more alphabetic characters. A player may submit selections to game server 130 through user interface 160. Selections may be picked from a list of previously entered selections, or other mechanism for displaying selectable predetermined content, or may be manually entered using user interface 160.

Players may submit selections for different types of Stock Market Races games. For example, a player may enter a list of selections and create a word race between friends or co-workers. A player may submit a word race selection for contest play wherein the selection is entered into a race with selections submitted by other players. A player may submit a selection as a wager oriented selection entry on a race. Contest or wager selections must be submitted by players before the designated contest race begins. A player may check results of races and contests anytime throughout the day.

Each selection entered in a word race has a score computed as the average of portfolio performance values for each unique portfolio indicia (letter) in the word. For instance, in this competition the selection of "CAT" would beat the selection of "DOG":

| | | | |
|---|---|---|---|
| C | 2.4035% | D | 2.2323% |
| A | 2.5818% | OQ | 2.2009% |
| T | 2.5624% | G | 2.0399% |
| CAT | 2.5159% | DOG | 2.1577% |

Each selection entered in a word race has a place value that determines the relative position of that selection compared to the other contest entries. If two or more word race entries contain the same set of unique letters, such as "ABCDEFG" and "GFEDCBA", then the tie is broken by comparing the place value of the portfolio having a unique indicia that corresponds to the first unique letter of the selection, then the second unique letter, then the third unique letter and so on.

In an embodiment, in case duplicate contest entries are received, or unique entries that still may not be separated by the tiebreaker rules (such as the unique letter sequence of "MICHEALA" and "MICHEMICAL" each being M, I, C, H, E, A, L) players may be prompted to submit an additional three-letter selection used to break the tie. The three letters submitted to break the tie must not be any of the letters used in the original selection. In an embodiment, a selection will be rejected, requesting that the three-letter tiebreaker be reentered, when the unique sequence of word entry and tiebreaker selection matches a previous selection.

Entry selection criterion such as limits of length or unique indicia count, are specified and may differ relative to each game. In an embodiment, selections may be divided into sub-contests where all selections compete only against other selections with equal unique indicia count. For example, a word races game may have a one winning selection among entries with six unique letters, one winning selection among entries with seven unique letters, one winning selection among entries with eight unique letters, and one winning selection among entries with nine unique letters.

Examples of illustrative games and races shall now be described in further detail. A group of Word Races games, categorized as amusement races, are intended for self-amusement of one or more people, by performing races between a number of selections, or by following the results of other races for enjoyment.

Figure 24:
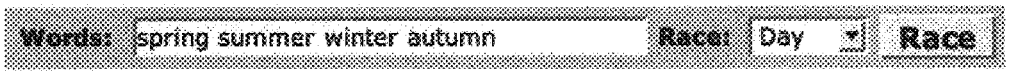
FIG. 24 is a pictorial representation of a Quick Races selection interface according to an embodiment of the invention.
Figure 25:
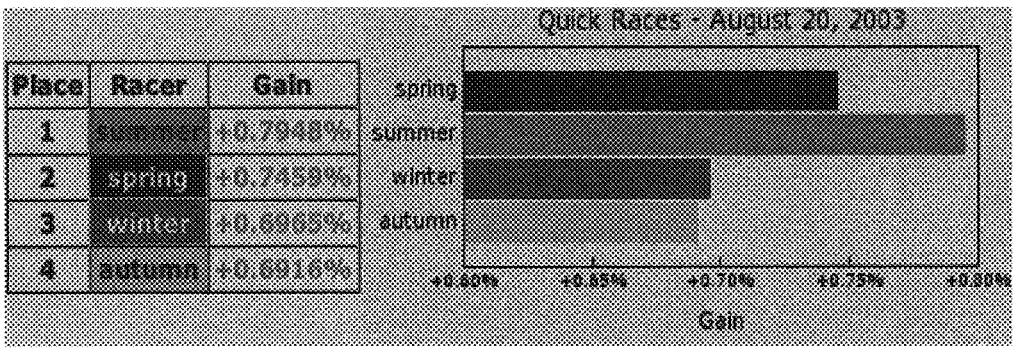
FIG. 25 is a pictorial representation of a table and graph displaying results of a Quick Race according to an embodiment of the invention.

In an embodiment, entitled "Quick Races", a user enters one or more word selections and a designated race, as shown in FIG. 24. The in progress, or final results (depending on the race selected and the current time) are displayed to the user, as shown in FIG. 25. A player may be able to determine the start time and end time of a Quick Race by submitting information through a displayable mechanism on user interface 160. An input mechanism is provided in user interface 160 wherein a player may submit one or more selections.

Figure 26:
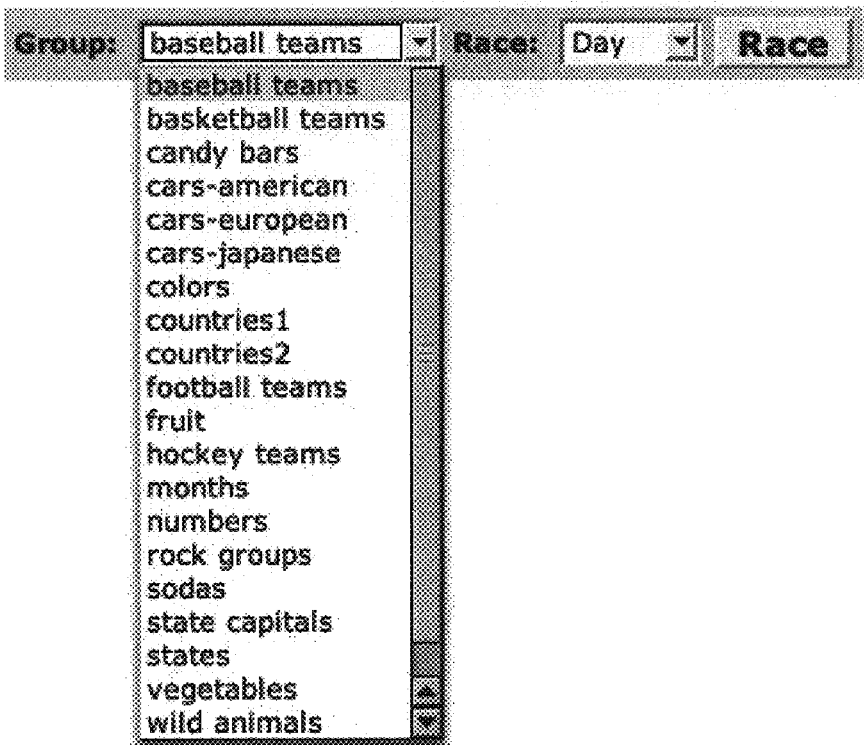
FIG. 26 is a pictorial representation of a Group Races selection interface according to an embodiment of the invention.
Figure 27:
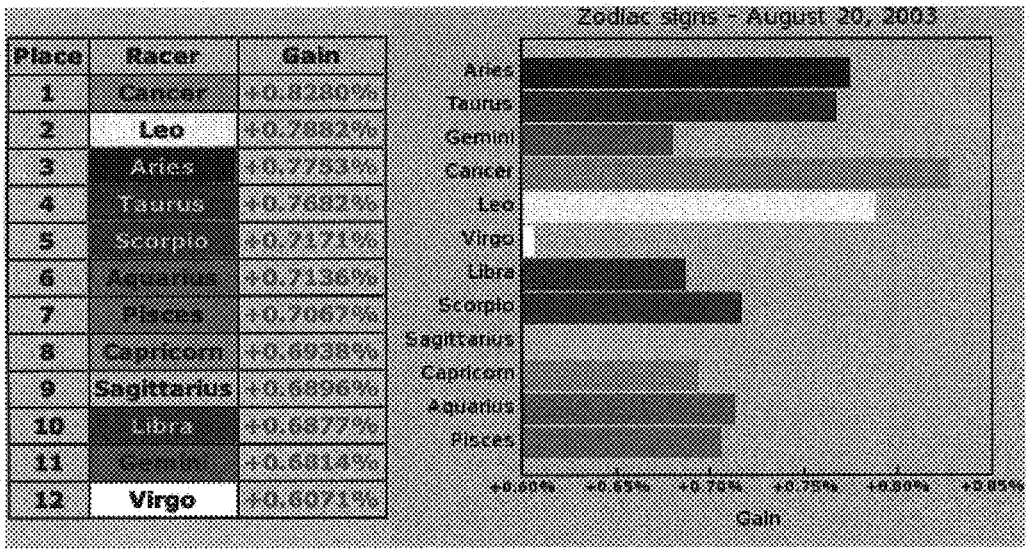
FIG. 27 is a pictorial representation of a table and graph displaying results of a Group Race according to an embodiment of the invention.

In an embodiment entitled "Group Races", races between preconfigured selections will be created and the results are made available for the public to follow. The preconfigured selections in a Group Race correspond to well-known group, such as, colors, states, sports teams, and zodiac signs. Group Races may be run at various times, e.g., or a day, week, or a different hours throughout the day. Other groups may be configured to race in a Group Race. A user selects a group of preconfigured selections as shown in FIG. 26. The in progress, or final results (depending on the race selected and the current time) are displayed to the user, as shown in FIG. 27.

In an embodiment entitled "City Races", a list of all cities within a geographic area are placed in a race together with rules that are similar to Word Races. Examples of geographic areas, which may be used, may include, but not be limited to, a country, a state, a designated set of countries, a continent, or even the whole world. City Races selections are divided by unique letter count.

Figure 28:
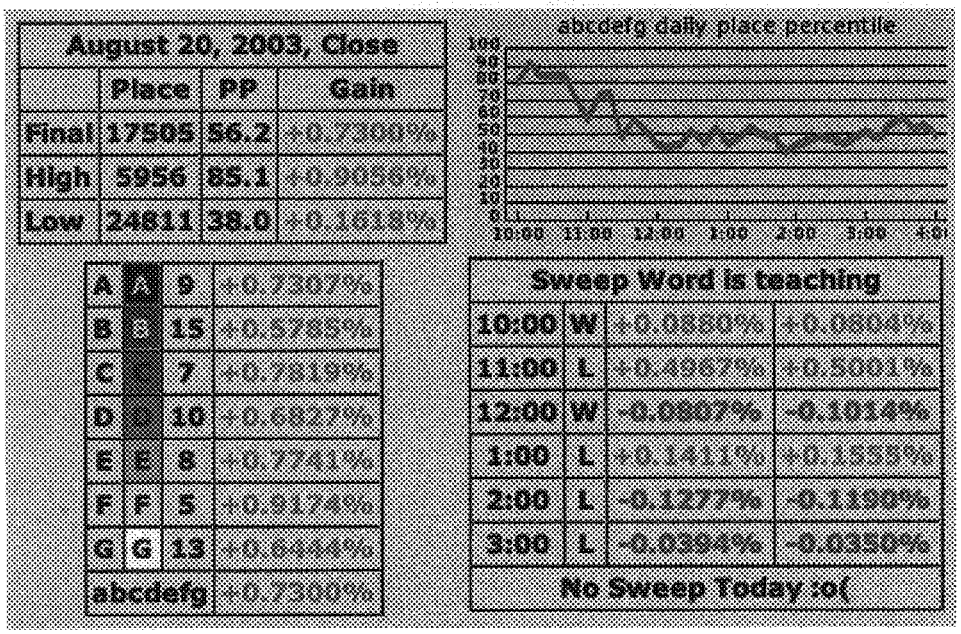
FIG. 28 is a pictorial representation of a table and graph displaying results of a Contest race selection according to an embodiment of the invention.

A second set of Stock Market Races games, categorized as contest races, shall now be described. In an embodiment entitled "Contest Races", players enter selections as previously described for competition in a race against other players to determine which player's selection finishes a race with either the highest or lowest change value among selections with equal unique indicia count. Information regarding the performance and status of a contest selection can be displayed to the user, as shown in FIG. 28. Each registered player may be limited to one entry per contest race. Winning players may be eligible for prizes. In an embodiment, selections that contain overtly offensive words or phrases may be rejected.

In an embodiment, players can enter unique selections per day, over a period of many days, and a sum of each selections score can be accumulated to serve as a final score for each player in contest. In an embodiment, players can enter six selections per day, all at once, or in succession over the course of the day, with the scores for each selection calculated using one of the six Hour Races and accumulated to produce a final score.

Figure 29:
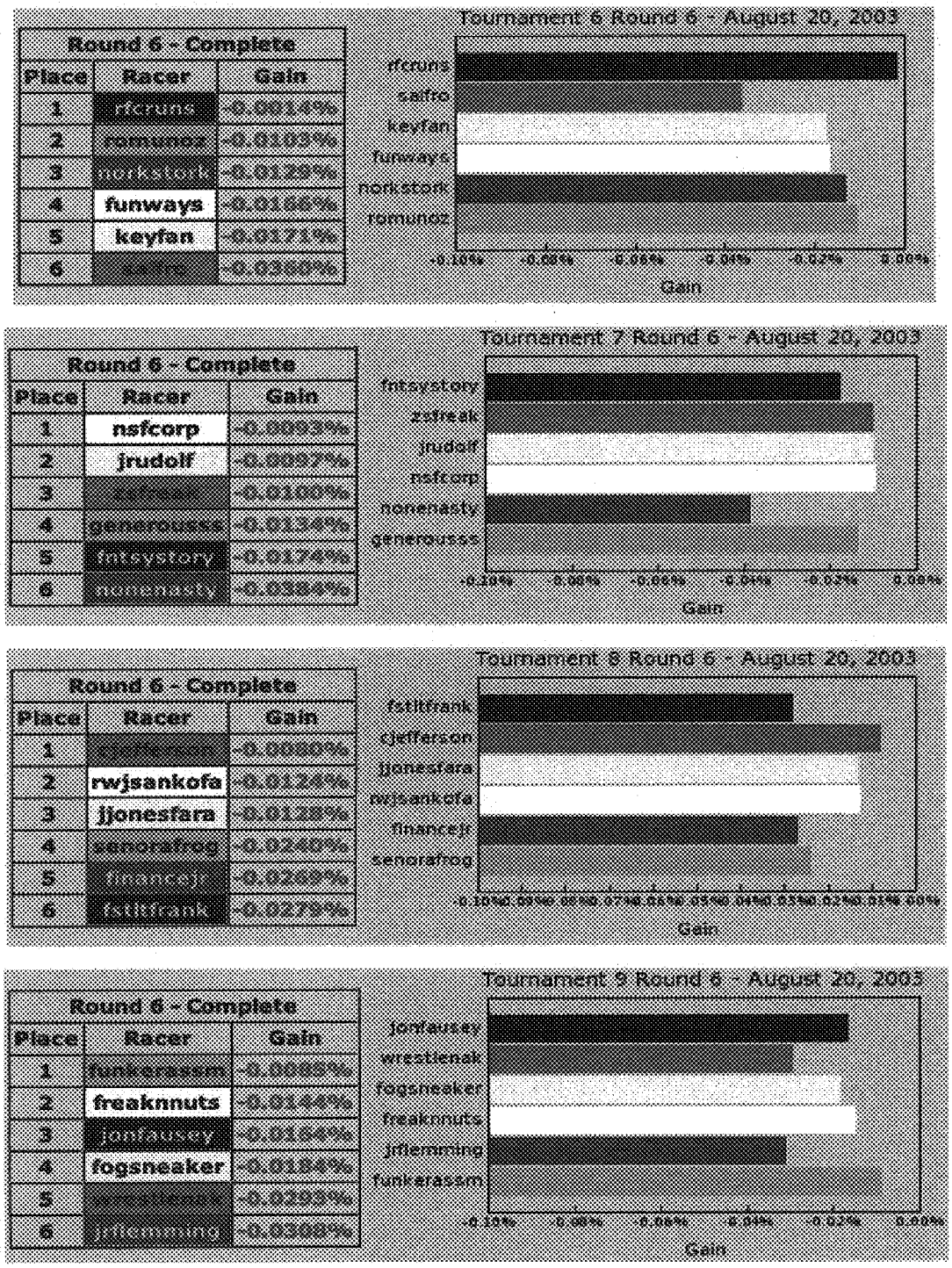
FIG. 29 is a pictorial representation of tables and graphs displaying final results of a Tournament Race according to an embodiment of the invention.
Figure 31:
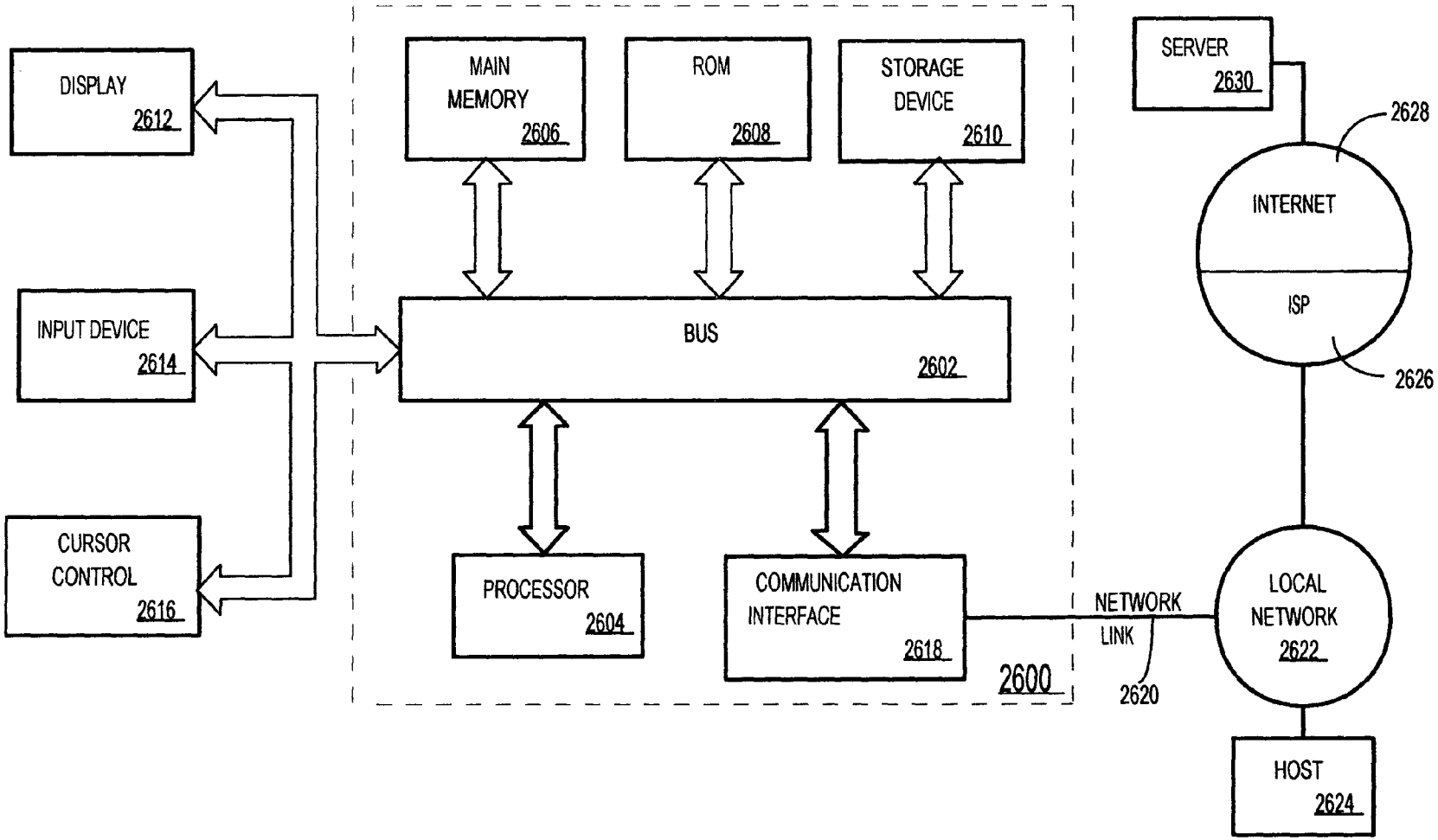
FIG. 31 is a block diagram illustrating a computer system in which an embodiment of the invention may be implemented.

In an embodiment, entitled "Tournament," player selections are divided into sets so that a six round tournament can be played each day. In each round, players compete in an Hour Race against a configurable number of opponents. The winners of each Hour Race each round moves on to the next round until a final winner for the day is declared in the final 3:00-4:00 race, as shown in FIG. 29. A status of a tournament selection can be displayed to the user. For example, FIG. 30 is a pictorial representation of a Tournament where the selection "walkonmars" has won its race in rounds one and two, but did not win round three.

A third set of Stock Market Races games is referred to as "Wager oriented games". Casinos, racetracks, sports books, and European betting shops may offer these games. Wager oriented games may be played for fun, or in a contest oriented fashion, but typically an entry of these games would constitute a wager of some sort with winning payouts for each winning entry paid at prescribed odds or paid in pari-mutuel fashion. Wagers on various propositions with a 50% chance of winning may be received and processed with an assigned vigorish, for example, 10% of the wager.

In an embodiment entitled "Stock Market Lottery, players may submit a selection for a race of a specific number of letters, typically between three and six. The letters on a winning ticket match the winning group sequence of the race's final result in exact order. Smaller payouts may be made for tickets where all selected letters are correct but sequence is incorrect, or where all but one of the selected letters are correct and in correct sequence.

In an embodiment entitled "Stock Market Derby", players may submit a selection for a race that is scored based upon how accurate the player is able to predict which group finishes each race in first place, second place, or third place. Available wagering possibilities would simulate a racetrack offering including Win, Place, Show, Exacta, or Trifecta. Stock Market Races payouts out are paid in pari-mutuel fashion.

In an embodiment entitled "Pick Six", players submit a selection of six characters. A player may be eligible for a prize upon submitting a winning selection to all of the Hour Races scheduled for a particular day. A player may also be eligible for a smaller payout for winning less than six Hour Races, but still having the most number of wins versus all other entrants that day e.g., winning all but one or two Hour Races. Similar to horse racing, a percentage of the wagers, referred to as a carryover, get moved into the following day's pool until a perfect ticket is selected.

In an embodiment, entitled "Top Ten", players submit a selection between one and ten unique characters. A player may be eligible for a prize when each indicium in their selection finishes a race in the top half among all portfolios. A single indicium in the selection, which finishes in the bottom half among all portfolios, considers the Top Ten selection a loser. Fixed odds may be paid to winning Top Ten selections according to the number of indicia included in the winning selection.

In an embodiment, entitled "Random Opponent", a player may submit a selection for a race. Thereafter, another random selection, having exactly the same unique letter count, is created which serves as a random opponent. A winning Random Opponent selection occurs when the player's selection score is higher than the score of the random opponent.

In an embodiment, entitled "Hour Sweep", each day a random selection having a preconfigured number of random letters (referred to as the "Hour Sweep Selection") is selected by game server 130 prior to the beginning of a race. Words are entered and scored according to Word Races rules against the Hour Sweep Selection. Each submitted selection by a player in the Hour Sweep must beat the Hour Sweep Selection in each of the day's six hour races to be eligible to win a prize. For example, FIG. 29 is a pictorial representation of an Hour Sweep with an Hour Sweep Selection of "teaching".

Finally, an additional wagering based embodiment would be to offer wagers on a popular set of Group Races such as states or zodiac signs. If there is variation in the unique letter counts of each word in the group, then payout must be made in pari-mutuel fashion. If adequate groups can be created using words which each have an equal unique letter count, then a fixed odds-based payout may be possible.

Implementing Mechanisms

FIG. 26 is a block diagram that illustrates a computer system 2600 upon which an embodiment of the invention may be implemented. Computer system 2600 includes a bus 2602 or other communication mechanism for communicating information, and a processor 2604 coupled with bus 2602 for processing information. Computer system 2600 also includes a main memory 2606, such as a random access memory (RAM) or other dynamic storage device, coupled to bus 2602 for storing information and instructions to be executed by processor 2604. Main memory 2606 also may be used for storing temporary variables or other intermediate information during execution of instructions to be executed by processor 2604. Computer system 2600 further includes a read only memory (ROM) 2608 or other static storage device coupled to bus 2602 for storing static information and instructions for processor 2604. A storage device 2610, such as a magnetic disk or optical disk, is provided and coupled to bus 2602 for storing information and instructions.

Computer system 2600 may be coupled via bus 2602 to a display 2612, such as a cathode ray tube (CRT), for displaying information to a computer user. An input device 2614, including alphanumeric and other keys, is coupled to bus 2602 for communicating information and command selections to processor 2604. Another type of user input device is cursor control 2616, such as a mouse, a trackball, or cursor direction keys for communicating direction information and command selections to processor 2604 and for controlling cursor movement on display 2612. This input device typically has two degrees of freedom in two axes, a first axis (e.g., x) and a second axis (e.g., y), that allows the device to specify positions in a plane.

The invention is related to the use of computer system 2600 for playing a game. According to one embodiment of the invention, playing a game is provided by computer system 2600 in response to processor 2604 executing one or more sequences of one or more instructions contained in main memory 2606. Such instructions may be read into main memory 2606 from another computer-readable medium, such as storage device 2610. Execution of the sequences of instructions contained in main memory 2606 causes processor 2604 to perform the process steps described herein. One or more processors in a multi-processing arrangement may also be employed to execute the sequences of instructions contained in main memory 2606. In alternative embodiments, hard-wired circuitry may be used in place of or in combination with software instructions to implement the invention. Thus, embodiments of the invention are not limited to any specific combination of hardware circuitry and software.

The term "computer-readable medium" as used herein refers to any medium that participates in providing instructions to processor 2604 for execution. Such a medium may take many forms, including but not limited to, non-volatile media, volatile media, and transmission media. Non-volatile media includes, for example, optical or magnetic disks, such as storage device 2610. Volatile media includes dynamic memory, such as main memory 2606. Transmission media includes coaxial cables, copper wire and fiber optics, including the wires that comprise bus 2602. Transmission media can also take the form of acoustic or light waves, such as those generated during radio wave and infrared data communications.

Common forms of computer-readable media include, for example, a floppy disk, a flexible disk, hard disk, magnetic tape, or any other magnetic medium, a CD-ROM, any other optical medium, punch cards, paper tape, any other physical medium with patterns of holes, a RAM, a PROM, and EPROM, a FLASH-EPROM, any other memory chip or cartridge, a carrier wave as described hereinafter, or any other medium from which a computer can read.

Various forms of computer readable media may be involved in carrying one or more sequences of one or more instructions to processor 2604 for execution. For example, the instructions may initially be carried on a magnetic disk of a remote computer. The remote computer can load the instructions into its dynamic memory and send the instructions over a telephone line using a modem. A modem local to computer system 2600 can receive the data on the telephone line and use an infrared transmitter to convert the data to an infrared signal. An infrared detector coupled to bus 2602 can receive the data carried in the infrared signal and place the data on bus 2602. Bus 2602 carries the data to main memory 2606, from which processor 2604 retrieves and executes the instructions. The instructions received by main memory 2606 may optionally be stored on storage device 2610 either before or after execution by processor 2604.

Computer system 2600 also includes a communication interface 2618 coupled to bus 2602. Communication interface 2618 provides a two-way data communication coupling to a network link 2620 that is connected to a local network 2622. For example, communication interface 2618 may be an integrated services digital network (ISDN) card or a modem to provide a data communication connection to a corresponding type of telephone line. As another example, communication interface 2618 may be a local area network (LAN) card to provide a data communication connection to a compatible LAN. Wireless links may also be implemented. In any such implementation, communication interface 2618 sends and receives electrical, electromagnetic or optical signals that carry digital data streams representing various types of information.

Network link 2620 typically provides data communication through one or more networks to other data devices. For example, network link 2620 may provide a connection through local network 2622 to a host computer 2624 or to data equipment operated by an Internet Service Provider (ISP) 2626. ISP 2626 in turn provides data communication services through the worldwide packet data communication network now commonly referred to as the "Internet" 2628.

Local network 2622 and Internet 2628 both use electrical, electromagnetic or optical signals that carry digital data streams. The signals through the various networks and the signals on network link 2620 and through communication interface 2618, which carry the digital data to and from computer system 2600, are exemplary forms of carrier waves transporting the information.

Computer system 2600 can send messages and receive data, including program code, through the network(s), network link 2620 and communication interface 2618. In the Internet example, a server 2630 might transmit a requested code for an application program through Internet 2628, ISP 2626, local network 2622 and communication interface 2618. In accordance with the invention, one such downloaded application provides for playing a game as described herein.

Processor 2604 may execute the received code as it is received, and/or stored in storage device 2610, or other non-volatile storage for later execution. In this manner, computer system 2600 may obtain application code in the form of a carrier wave.

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A method for playing a game, comprising:

creating a plurality of groups that each comprises one or more items, wherein each of the groups is associated with a unique indicium, wherein each of the items has an identifying feature associated with one of the indicium, and wherein each of the one or more items is associated with one or more values;

receiving one or more selections from a player that each comprise one or more characters, wherein each of the characters in each selection corresponds to one of the indicium;

determining a performance value for each group over a period of time;

determining a sequence of the plurality of groups based upon the performance value for the period of time; and determining a score for each of the one or more selections, wherein the score determines a basis for winning the game.

2. The method of claim 1, further comprising the following step:

determining a game period associated with the game, wherein the game period has a start point and an end point.

3. The method of claim 2, further comprising the following step:

retrieving the one or more values associated with each item over the game period.

4. The method of claim 3, further comprising the following step:

determining a change value for each item in each of the plurality of groups over the game period.

5. The method of claim 4, further comprising the following step:

determining a winning selection from the one or more selections based on the score associated with each of the one or more selections.

6. The method of claim 5, further comprising the following step:

transmitting a notification to a winning player associated with the winning selection that the winning player is eligible for a prize.

7. A method for playing a game, comprising:

creating a plurality of groups that each comprises one or more items, wherein each of the groups is associated with a unique indicium, wherein each of the items has an identifying feature associated with one of the indicium, and wherein each of the one or more items is associated with one or more values, wherein each of the one or more values fluctuates over time;

determining a game period associated with the game, wherein the game period has a start point and an end point;

retrieving the one or more values associated with each item over the game period;

receiving one or more selections from one or more players that each comprise one or more characters, wherein each of the characters in each selection corresponds to one of the indicium, and wherein each selection is associated with the game period;

determining a change value for each item in each of the plurality of groups over the game period;

determining a performance value for each group over the game period that reflects the change value for each item in each group over the game period;

determining a sequence of the plurality of groups based upon the performance value for the game period;

determining a score for each of the one or more selections, wherein the score reflects the performance values for each group associated with the each unique indicia in the selection for each of the one or more selections;

determining a winning selection from the one or more selections based on the score associated with each of the one or more selections; and transmitting a notification to a winning player associated with the winning selection that the winning player is eligible for a prize.

8. The method of claim 7, wherein the items in each group are updated on periodic basis based on a comparison of data values and change values over a prior period associated with each item having an identifying feature that corresponds to the indicium associated with the group.

9. The method of claim 7, wherein the identity of each item in each group is made available to the one or more players before the start point.

10. The method of claim 7, wherein each of the unique indicia is one or more alphabetic letters.

11. The method of claim 7, wherein an indicium that comprises more than one characters represents each of the characters it comprises.

12. The method of claim 7, wherein the identifying feature of each item is associated with the indicium corresponding to the identifying feature of the group of which the item is a member.

13. The method of claim 7, wherein the game period is one member selected from the group consisting of: one day, one hour, one week, and a configurable duration with the start point indicated by one of the one or more players.

14. The method of claim 7, further comprising: upon receipt of the one or more selections, determining if the one or more selections meet a specified set of criteria.

15. The method of claim 7, wherein each change value reflects the percentage change between the data value to which the change value is associated with at the start point and the data value to which the change value is associated with a current time.

16. The method of claim 7, wherein the performance value for each of the one or more groups reflects an average change value for each item in the group.

17. The method of claim 7, wherein the score for each of the one or more selections reflects an average performance value for each unique indicium in the selection.

18. The method of claim 7, further comprising: storing the one or more values, the changes values associated with each item, the performance value for each group, and the sequence of the plurality of groups for the game period in persistent storage.

19. The method of claim 7, further comprising: creating one or more graphical displays depicting the one or more data values and change values associated with each item.

20. The method of claim 7, further comprising: creating one or more graphical displays depicting the performance values associated with the one or more groups.

21. The method of claim 7, further comprising: creating one or more graphical displays depicting the sequence of the plurality of groups.

22. The method of claim 7, further comprising: creating one or more graphical displays depicting the score associated with the one or more selections.

23. The method of claim 7, further comprising: creating one or more graphical displays depicting the results of a number of previous games.

24. method of claim 7, further comprising: creating one or more graphical displays depicting the current odds of wagers of one or more selections.

25. The method of claim 7, further comprising: creating one or more graphical displays depicting a current estimation of jackpots paid to the one or more players with a winning selection.

26. The method of claim 7, further comprising displaying the one or more graphical displays on a graphical user interface to the one or more players.

27. The method of claim 7, wherein one or more selections are received from the player through a graphical user interface, wherein displays of the scores of each of the selections are created and displayed to the user on a graphical interface.

28. The method of claim 7, wherein a number of selections are chosen by the player from a list of one or more sets of selections displayed on a graphical user interface, wherein displays of the scores of each of the selections are created and displayed to the user on a graphical interface.

29. The method of claim 7, wherein each of the one or more selections is supplied by each of the one or more players through a graphical user interface.

30. The method of claim 7, wherein the winning selections are the selections with the highest or lowest scores at the end point of the game period.

31. The method of claim 7, wherein the step of determining the winning selections among each of the one or more selections comprises grouping the selections based on the number of unique characters included in each selection.

32. The method of claim 7, further comprising:

receiving a set of one or more tournament selections, wherein each tournament selection may be submitted by a different player through a graphical user interface, wherein each tournament selection comprises one or more characters, and wherein each of the characters in each tournament selection corresponds of one of the indicium;

grouping the set of one or more tournament selections into a plurality of brackets, wherein the plurality of brackets comprises a series of levels;

determining a tournament score for each of the one or more tournament selections in the first level bracket; and determining which of the one or more tournament selections advances to the next level of the bracket based upon the tournament score of each tournament selections in the first level bracket.

33. The method of claim 7, wherein each selection further comprises a bet value and a bet type, wherein the bet value is an amount of money that the player intends to bet on the selection, and wherein the bet type is a type of bet which the player intends to place using the selection.

34. The method of claim 7, wherein winning wager selections are determined by a degree of match between the sequence of indicia of the selection and the sequence of indicia at the ending time of a game period.

35. The method of claim 7, further comprising: transmitting a notification to a winning player associated with the winning selection that the winning player is eligible for a prize.

36. The method of claim 7, wherein each item is an openly traded instrument, and wherein each data value is a price of the openly traded instrument to which the data value is associated.

37. The method of claim 36, wherein the identifying feature of each item is a first letter of a ticker symbol associated with an openly traded instrument.

38. The method of claim 36, wherein the set of indicium associated with each group correspond to the following groups of letters: A, B, C, D, E, F, G, H, I, JK, L, M, N, OQ, P, R, S, T, UV, and WXYZ.

39. The method of claim 36, wherein the performance value of a group for the game period is based, at least in part, on an average price change of each openly traded security of which the group comprises.

40. The method of claim 36, wherein determining the performance value for each group further comprises ignoring trades of each openly traded instrument associated with an item in each group which cause a price associated with the openly traded instrument to change beyond a specified threshold.

41. The method of claim 7, wherein each item corresponds to data related to a temperature in a city.

42. The method of claim 7, wherein each item corresponds to data related to a sports statistic.

43. A system for playing a game based upon fluctuations of the stock market comprising:

a source of data related to the price of stock create a plurality of groups that each comprises one or more items, wherein each of the groups is associated with a unique indicium, wherein each of the items has an identifying feature associated with one of the indicium, and wherein each of the one or more items is associated with one or more values;

a database comprising data related to the fluctuation in the price of stock over time;

a game server comprising the following:

an optional update module;

a race module determines a performance value for each group over a period of time and determines a sequence of the plurality of groups based upon the performance value for the period of time;

an optional contest module;

an optional display module;

an optional user interface module; and one or more user interfaces.

44. The system of claim 43 wherein the source of data related to the price of stock further comprises a real-time connection to current stock prices.

45. The system of claim 43 wherein the database comprising data related to the fluctuation in the price of stock over time further comprises data related to random or predetermined play selections made by a user during play of the game.

46. The system of claim 43 wherein the one or more user interfaces is selected from the group consisting of a web browser, a touch screen, a television screen, a Palm pilot or other PDA, a personal computer such as including a monitor, keyboard and mouse, a cellular telephone display, a pager, an electronic ticketing device, and a screen displayable in a kiosk or other standalone terminal.

47. An optionally web server-based game based upon fluctuations of the stock market comprising:

obtaining a source of data related to the price of stock, such as over the internet via connection to on-line stock market websites creating a plurality of groups that each comprises one or more items, wherein each of the groups is associated with a unique indicium, wherein each of the items has an identifying feature associated with one of the indicium, and wherein each of the one or more items is associated with one or more values;

creating a database comprising data related to the fluctuation in the price of stock over time as well as data related to random or predetermined play selections made by a user, via one or more user interfaces, during play of the game; and communicating the database to a game server comprising the following:

an optional update module;

a race module determining a performance value for each group over a period of time and determining a sequence of the plurality of groups based upon the performance value for the period of time;

an optional contest module;

an optional display module;

an optional user interface module.

* * * * *